US009316421B2

(12) United States Patent
Tanaka et al.

(10) Patent No.: US 9,316,421 B2
(45) Date of Patent: Apr. 19, 2016

(54) AIR-CONDITIONING APPARATUS INCLUDING UNIT FOR INCREASING HEATING CAPACITY

(75) Inventors: Kosuke Tanaka, Tokyo (JP); Tomohiko Kasai, Cypress, CA (US)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 896 days.

(21) Appl. No.: 13/565,541

(22) Filed: Aug. 2, 2012

(65) Prior Publication Data

US 2014/0033750 A1 Feb. 6, 2014

(51) Int. Cl.

*F25B 13/00* (2006.01)
*F25B 41/04* (2006.01)
*F25B 25/00* (2006.01)

(52) U.S. Cl.

CPC ..... *F25B 13/00* (2013.01); *F25B 41/04* (2013.01); *F25B 25/005* (2013.01); *F25B 2313/009* (2013.01); *F25B 2313/0215* (2013.01); *F25B 2313/0233* (2013.01); *F25B 2313/02731* (2013.01); *F25B 2313/02741* (2013.01); *F25B 2400/16* (2013.01); *F25B 2500/31* (2013.01); *F25B 2600/2507* (2013.01); *F25B 2700/2106* (2013.01)

(58) Field of Classification Search

CPC ..... F25B 25/005; F25B 2313/009; F25B 2313/0213; F25B 2313/0214; F25B 2313/0215; F25B 2500/31

See application file for complete search history.

(56) References Cited

U.S. PATENT DOCUMENTS 5,765,380 A * 6/1998 Misawa et al. ..... 62/210
2011/0067436 A1 3/2011 Lee

FOREIGN PATENT DOCUMENTS

| | | | |
|---|---|---|---|
| EP | 1 312 877 | A2 | 5/2003 |
| EP | 2 336 676 | A2 | 6/2011 |
| EP | 2 339 268 | A2 | 6/2011 |
| JP | 7-22375 | U | 4/1995 |
| JP | H08-086528 | A | 4/1996 |
| JP | 2989491 | B2 | 12/1999 |

OTHER PUBLICATIONS

JP 08-086528 (English translation).*

(Continued)

*Primary Examiner* — Jonathan Bradford
(74) *Attorney, Agent, or Firm* — Buchanan Ingersoll & Rooney PC

(57) ABSTRACT

An air-conditioning apparatus including a check valve in a passage between a first flow switching device and a suction side of a compressor, an expansion valve midway of a liquid extension piping, and an additional unit having a first bypass and a second bypass that are branched off from a passage between an indoor unit and the liquid expansion valve, and are connected to a passage between the check valve and the suction side of the compressor. The first bypass has, midway thereof, a first bypass expansion valve capable of controlling a throughput of refrigerant and an auxiliary heat exchanger that has a heat source different from the refrigerant, the auxiliary heat exchanger functioning as an evaporator heating the refrigerant flowing in the first bypass. The second bypass has, midway thereof, a second bypass expansion valve capable of controlling a throughput of refrigerant.

14 Claims, 12 Drawing Sheets

(56) References Cited

OTHER PUBLICATIONS

Notification of Transmittal of the International Search Report (Forms PCT/ISA/220 and PCT/ISA/210) and the Written Opinion of the International Searching Authority (Form PCT/ISA/237) issued on Jan. 28, 2014, by the International Bureau of WIPO in corresponding International Application No. PCT/JP2013/004615. (17 pages).

Office Action dated Sep. 1, 2015 issued in the corresponding Japanese Patent Application No. 2015-505740 and English translation (5 pages).

Communication and Search Report dated Jan. 25, 2016 issued in the corresponding European Patent Application No. 15161413.8 (9 pages).

* cited by examiner

AIR-CONDITIONING APPARATUS INCLUDING UNIT FOR INCREASING HEATING CAPACITY

TECHNICAL FIELD

The present invention relates to an air-conditioning apparatus, and more particularly, to an air-conditioning apparatus including a unit for increasing heating capacity suitable for use in cold districts.

BACKGROUND ART

There is a known air-conditioning apparatus for carrying out heating under a low outdoor air temperature environment of about −10 degrees C. that performs injection of a gas refrigerant or a two-phase refrigerant into a compressor. However, even in an injection type air-conditioning apparatus, further drop in the outdoor air temperature will cause the heating capacity ratio (the actual exerted capacity over the inherent capacity) to drop.

Additionally, if the low outdoor air temperature drops even further, the evaporating temperature of the refrigeration cycle becomes low and the discharge temperature of the compressor increases, hindering normal operation due to the need to protect the compressor.

Meanwhile, there is a known air-conditioning apparatus that has increased its heating capacity by using a heat source (external heat source) other than the refrigerant flowing in the refrigerant circuit of the refrigeration cycle. For example, there is an air-conditioning apparatus that enables continuous heating operation by securing a heating capacity of a heat pump air-conditioning apparatus by utilizing hot water of a boiler (Patent Literature 1). Furthermore, there is a known air-conditioning apparatus that carries out heating by simultaneously utilizing an air-cooled heat exchanger and a water-cooled heat exchanger, which uses hot water of a boiler, when the outdoor air temperature is low (Patent Literature 2).

CITATION LIST

Patent Literature

Patent Literature 1: Japanese Unexamined Patent Application Publication No. 7-22375 (FIG. 1)

Patent Literature 2: Japanese Patent No. 2989491 (FIG. 7)

DISCLOSURE OF INVENTION

Problems to be Solved by the Invention

Since the above Patent Literature 1 is configured such that heat is exchanged between air heated by hot water of a boiler and a refrigerant flowing in a refrigerant circuit of a refrigeration cycle through an air heat exchanger, its heat transfer efficiency is low.

Furthermore, the above Patent Literature 2 is configured to use two compressors, and in a case where outdoor air temperature is low, one of the compressors (Patent Literature 2, FIG. 2, reference numeral 22) is brought into a non-operational state. Additionally, in the above Patent Literature 2, since a check valve that is provided to the suction portion of the compressor becomes a cause of pressure loss due to low pressure, capacity is reduced.

The invention corresponds to the above problems, and provides an air-conditioning apparatus that is capable of efficiently securing a desired heating capacity under a low outdoor air temperature environment such as a cold district where the outdoor temperature drops below −15 degrees C.

Means for Solving Problems

In order to cope with the above problems, the disclosure proposes the following air-conditioning apparatus:

(1) An air-conditioning apparatus, including:

an outdoor unit including a compressor that compresses and discharges a refrigerant, a first flow switching device that switches a passage of the refrigerant discharged from the compressor, and an outdoor heat exchanger that is connected by piping to the first flow switching device and is used to evaporate or condense the refrigerant;

an indoor unit including an indoor heat exchanger that functions as a condenser condensing the refrigerant discharged from the compressor during a heating operation and an indoor expansion valve that controls a flow rate of the refrigerant leaving the indoor heat exchanger during the heating operation;

a gas extension piping constituting a passage communicating the first flow switching device of the outdoor unit to the indoor heat exchanger of the indoor unit;

a liquid extension piping constituting a passage communicating the indoor expansion valve of the indoor unit to the outdoor heat exchanger of the outdoor unit;

a refrigerant circuit of a refrigeration cycle being formed by the outdoor unit and the indoor unit connected through the gas extension piping and the liquid extension piping;

a check valve being provided in a passage between the first flow switching device and a suction side of the compressor;

a liquid piping expansion valve being provided midway of the liquid extension piping, the liquid piping expansion valve being capable of controlling a throughput of the refrigerant;

an additional unit having a first bypass and a second bypass that branch off from a passage between the indoor unit and the liquid piping expansion valve, the first bypass and the second bypass communicating to a passage between the check valve and the suction side of the compressor;

the first bypass having, in midway thereof, a first bypass expansion valve that is capable of controlling a throughput of the refrigerant and an auxiliary heat exchanger with a different heat source for heating to a heat source of the refrigerant, the auxiliary heat exchanger functioning as an evaporator that heats the refrigerant flowing in the first bypass during the heating operation; and the second bypass having, in midway thereof, a second bypass expansion valve that is capable of controlling a throughput of the refrigerant.

(2) An air-conditioning apparatus, including:

an outdoor unit including a compressor that compresses and discharges a refrigerant, a discharge port that discharges the refrigerant that has been discharged from the compressor to an outer portion, a first flow switching device that is connected to a passage branching off from a passage between the compressor and the discharge port and that switches a passage of the refrigerant discharged from the compressor, an outdoor heat exchanger that is connected by piping to the first flow switching device and is used to evaporate or condense the refrigerant, and an on-off device that opens and closes the branched off passage between the compressor and the first flow switching device;

an indoor unit including an indoor heat exchanger that functions as a condenser condensing the refrigerant discharged from the compressor during a heating operation and an indoor expansion valve that controls a flow rate of the refrigerant leaving the indoor heat exchanger during the heating operation;

a gas extension piping constituting a passage communicating the discharge port of the outdoor unit to the indoor heat exchanger of the indoor unit;

a liquid extension piping constituting a passage communicating the indoor expansion valve of the indoor unit to the outdoor heat exchanger of the outdoor unit;

a refrigerant circuit of a refrigeration cycle being formed by the outdoor unit and the indoor unit connected through the gas extension piping and the liquid extension piping;

a second flow switching device being provided midway of the gas extension piping, the second flow switching device communicating the indoor heat exchanger to a discharge side of the compressor during the heating operation and communicating the indoor heat exchanger to a suction side of the compressor during a cooling operation;

a liquid piping expansion valve being provided midway of the liquid extension piping, the liquid piping expansion valve being capable of controlling a throughput of the refrigerant;

an additional unit having a first bypass and a second bypass that branch off from a passage between the indoor unit and the liquid piping expansion valve, the first bypass and the second bypass communicating to a passage between the first flow switching device and the suction side of the compressor;

the first bypass having, in midway thereof, a first bypass expansion valve that is capable of controlling a throughput of the refrigerant and an auxiliary heat exchanger with a different heat source for heating to a heat source of the refrigerant, the auxiliary heat exchanger functioning as an evaporator that heats the refrigerant flowing in the first bypass during the heating operation; and the second bypass having, in midway thereof, a second bypass expansion valve that is capable of controlling a throughput of the refrigerant.

(3) An air-conditioning apparatus, including:

an outdoor unit including a compressor that compresses and discharges a refrigerant, a discharge port that discharges the refrigerant that has been discharged from the compressor to an outer portion, a first flow switching device that is connected to a passage branching off from a passage between the compressor and the discharge port and that switches a passage of the refrigerant discharged from the compressor, an outdoor heat exchanger that is connected by piping to the first flow switching device and is used to evaporate or condense the refrigerant, an on-off device that opens and closes the branched off passage between the compressor and the first flow switching device, an outdoor expansion valve that is provided on an upstream side of the outdoor heat exchanger during heating operation, a receiver that retains the refrigerant, and an intermediate-pressure port provided in a passage branching off from the passage between the outdoor heat exchanger and the receiver;

an indoor unit including an indoor heat exchanger that functions as a condenser condensing the refrigerant discharged from the compressor during a heating operation and an indoor expansion valve that controls a flow rate of the refrigerant leaving the indoor heat exchanger during the heating operation;

a gas extension piping constituting a passage communicating the discharge port of the outdoor unit to the indoor heat exchanger of the indoor unit;

a liquid extension piping constituting a passage communicating the indoor expansion valve of the indoor unit to the receiver of the outdoor unit;

a refrigerant circuit of a refrigeration cycle being formed by the outdoor unit and the indoor unit connected through the gas extension piping and the liquid extension piping;

a second flow switching device being provided midway of the gas extension piping, the second flow switching device communicating the indoor heat exchanger to a discharge side of the compressor during the heating operation and communicating the indoor heat exchanger to a suction side of the compressor during a cooling operation;

an additional unit having a first bypass and a second bypass, the first bypass and the second bypass each having one end in communication with the intermediate-pressure port of the outdoor unit and the other end in communication with a passage between the first flow switching device and the suction side of the compressor;

the first bypass having, in midway thereof, a first bypass expansion valve that is capable of controlling a throughput of the refrigerant and an auxiliary heat exchanger with a different heat source for heating to a heat source of the refrigerant, the auxiliary heat exchanger functioning as an evaporator that heats the refrigerant flowing in the first bypass during the heating operation; and the second bypass having, in midway thereof, a second bypass expansion valve that is capable of controlling a throughput of the refrigerant.

(4) An air-conditioning apparatus, comprising:

an outdoor unit including a compressor that compresses and discharges a refrigerant, a first flow switching device that switches a passage of the refrigerant discharged from the compressor, and an outdoor heat exchanger that is connected by piping to the first flow switching device and is used to evaporate or condense the refrigerant;

a flow dividing controller being connected to the outdoor unit through a high-pressure side piping and a low-pressure side piping, the flow dividing controller including a gas-liquid separator that separates the refrigerant sent from the outdoor unit into a gas refrigerant and a liquid refrigerant, a gas piping that distributes the gas refrigerant separated in the gas-liquid separator, a liquid piping that distributes the liquid refrigerant separated in the gas-liquid separator, and a return piping that is connected to the low-pressure side piping, a flow-dividing-controller expansion valve that controls a flow rate of the refrigerant flowing in the liquid piping and being provided in the liquid piping, a return bypass communicating a downstream side of the flow-dividing-controller expansion valve in the liquid piping to the return piping, and a return bypass expansion valve that is capable of controlling a throughput of the refrigerant and being provided in midway of the return bypass;

a plurality of indoor units each including an indoor heat exchanger and an indoor expansion valve, each of the indoor units being connected to the gas piping, the liquid piping, and the return piping of the flow dividing controller and being connected to the flow dividing controller in parallel;

an additional unit including an auxiliary heat exchanger that exchanges heat between the refrigerant and a heat medium heated in a heat source for heating different to the refrigerant and a first bypass expansion valve that is capable of controlling a throughput of the refrigerant and that controls the amount of heat exchange in the auxiliary heat exchanger, the additional unit being connected to the gas piping, the liquid piping, and the return piping of the flow dividing controller and being connected to the flow dividing controller in parallel with the plurality of indoor units; and a refrigerant circuit of a refrigeration cycle being formed by the outdoor unit, the flow dividing controller, the plurality of indoor units, and the additional unit, the refrigerant circuit of the refrigeration cycle being capable of simultaneously operating a heating operation and a cooling operation using the plurality of indoor units.

Effects of the Invention

In the air-conditioning apparatus configured as above, since heat is added to the refrigerant by the external heat source in the auxiliary heat exchanger, the evaporating temperature of the refrigerant in the refrigeration cycle becomes high and rise of the discharge temperature of the compressor is suppressed. Accordingly, it will be possible to continuously carry out heating operation under a low outdoor air temperature environment. Furthermore, since the evaporating temperature of the refrigerant in the refrigeration cycle increases, the amount of refrigerant circulation increases and the heating capacity increases.

MODES FOR CARRYING OUT THE INVENTION

Embodiment 1

Figure 1:
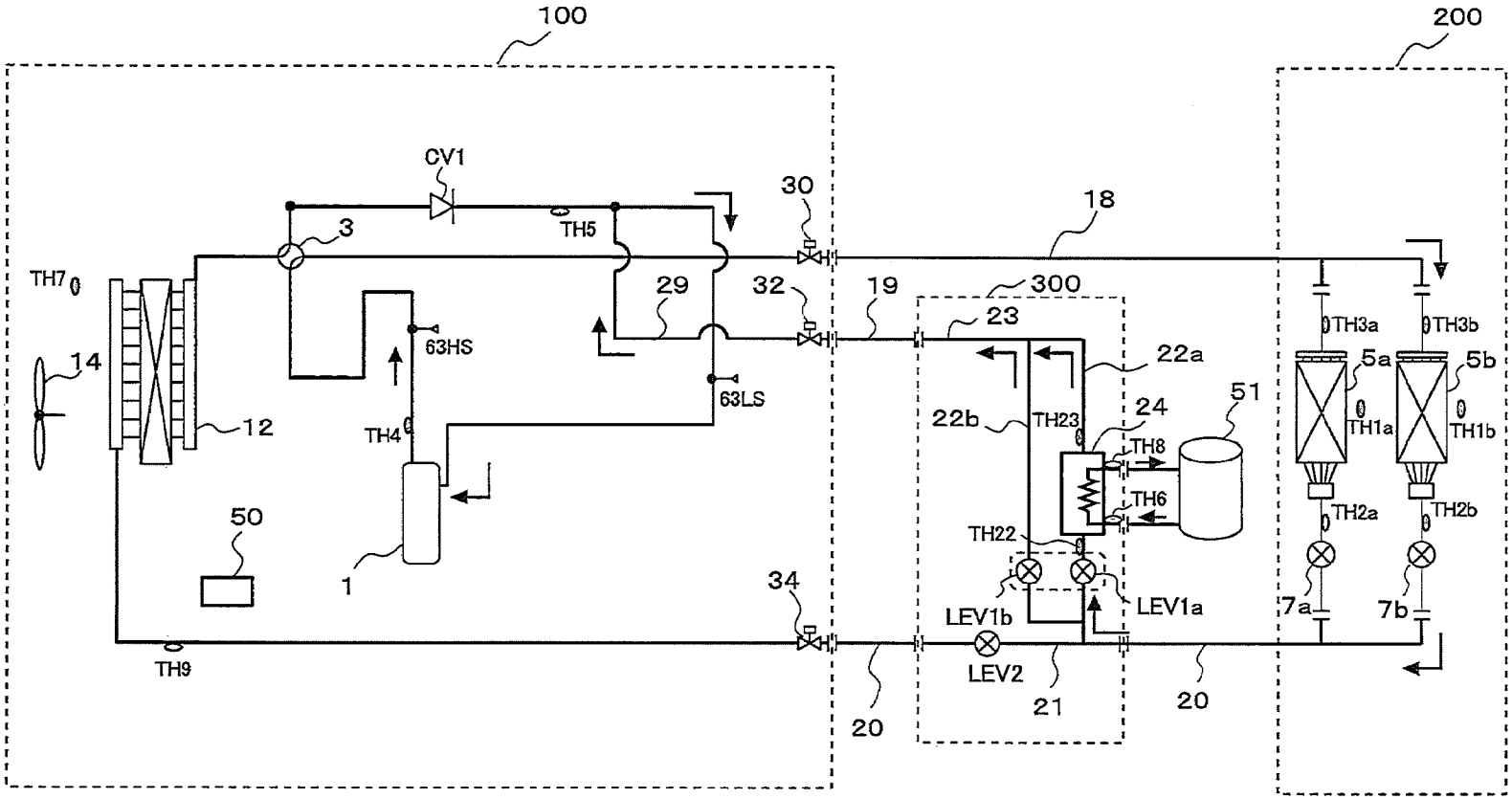
FIG. 1 is a block diagram of an air-conditioning apparatus illustrating Embodiment 1 of the invention.

An air-conditioning apparatus of Embodiment 1 of the invention will be subsequently described with reference to FIG. 1. FIG. 1 is an air-conditioning apparatus capable of switching between a heating operation and a cooling operation. As illustrated in FIG. 1, a refrigerant circuit of a refrigeration cycle is formed by a compressor 1, a four-way valve 3 serving as a flow switching device, indoor heat exchangers 5*a* and 5*b*, indoor expansion valves 7*a* and 7*b*, a liquid piping expansion valve LEV2, and an outdoor heat exchanger 12. Note that the arrows in FIG. 1 indicate a refrigerant flow in a heating operation in which the outdoor heat exchanger 12 is not used.

The compressor 1, the four-way valve 3, and the outdoor heat exchanger 12 are disposed in an outdoor unit 100. The outdoor unit 100 is provided with a temperature sensor TH4 that detects a temperature of the refrigerant discharged from the compressor 1, a high-pressure sensor 63HS that detects a pressure of the refrigerant discharged from the compressor 1, a check valve CV1 provided in a passage between the four-way valve 3 and the compressor 1, a temperature sensor TH5 that detects a temperature of the refrigerant on an input side or an output side of the check valve CV1, and a low-pressure sensor 63LS that detects a pressure of the refrigerant on an inlet side of the compressor 1. The outdoor unit 100 is further provided with an outdoor fan 14 that blows air to the outdoor heat exchanger 12, a temperature sensor TH7 that detects a temperature of air (outdoor air) that exchanges heat in the outdoor heat exchanger 12, and a temperature sensor TH9 that detects a temperature of the refrigerant flowing into the outdoor heat exchanger 12 during the heating operation (or a temperature of the refrigerant flowing out of the outdoor heat exchanger 12 during the cooling operation).

Furthermore, the outdoor unit 100 is provided with an inlet bypass 29 that branches off from between the check valve CV1 and an inlet of the compressor 1 reaching an inlet port 32. This inlet bypass 29 is connected to an additional unit 300 described below through a bypass extension piping 19 that is connected to the inlet port 32.

The indoor heat exchangers 5*a* and 5*b* and the indoor expansion valves 7*a* and 7*b* constitute indoor units 200. The indoor units 200 are provided with temperature sensors TH1*a* and TH1*b* that each detect a temperature of suction air that exchanges heat in the indoor heat exchangers 5*a* and 5*b*, respectively, and temperature sensors TH2*a*, TH2*b*, TH3*a*, and TH3*b* that each detects a temperature of the refrigerant before or after the indoor heat exchangers 5*a* or 5*b*. Note that the number of indoor heat exchangers is not limited to two and any appropriate number may be allowed. Each indoor heat exchanger may air condition different spaces or may air condition the same space. Note that the indoor heat exchangers 5*a* and 5*b* and the indoor expansion valves 7*a* and 7*b* do not necessarily have to be disposed in the same housing (the same applies to the other Embodiments).

The outdoor unit 100 and the indoor units 200 are connected through a gas extension piping 18 and a liquid extension piping 20. Note that the gas extension piping 18 is connected to a discharge/suction port 30 of the outdoor unit 100 and the liquid extension piping 20 is connected to a suction/discharge port 34 of the outdoor unit 100.

The additional unit 300 is provided between the outdoor unit 100 and the indoor units 200. The additional unit 300 is provided with a unit liquid piping 21 constituting a portion of the liquid extension piping 20, the liquid piping expansion valve LEV2 that is provided in the unit liquid piping 21, a first bypass 22*a* and a second bypass 22*b* that are parallel passages branched off from the passage between the liquid piping expansion valve LEV2 and the indoor units 200, a first bypass expansion valve LEV1*a* and a second bypass expansion valve LEV1*b* provided in each bypass, and an auxiliary heat exchanger 24 disposed in the first bypass 22*a* in series with the expansion valve LEV1*a*. The auxiliary heat exchanger 24 exchanges heat between a refrigerant flowing in the first bypass 22*a* and a heat medium, such as water (hereinafter, referred to as "water"), heated with an external heat source (a heat source different from the refrigerant), such as a boiler 51, and includes a plate heat exchanger, for example. Temperature sensors TH22 and TH23 that detect refrigerant temperatures are provided in the refrigerant inlet and outlet of the auxiliary heat exchanger 24 in the first bypass 22*a*. Temperature sensors TH6 and TH8 that detect water temperatures in their respective positions are further provided in the water inlet and outlet of the auxiliary heat exchanger 24. Note that the first bypass 22*a* and the second bypass 22*b* are connected to the inlet port 32 of the outdoor unit 100 through a merging bypass 23 and the bypass extension piping 19.

Note that in this description, various extension valves described in the description may each be simply referred to as an "extension valve".

Figure 6:
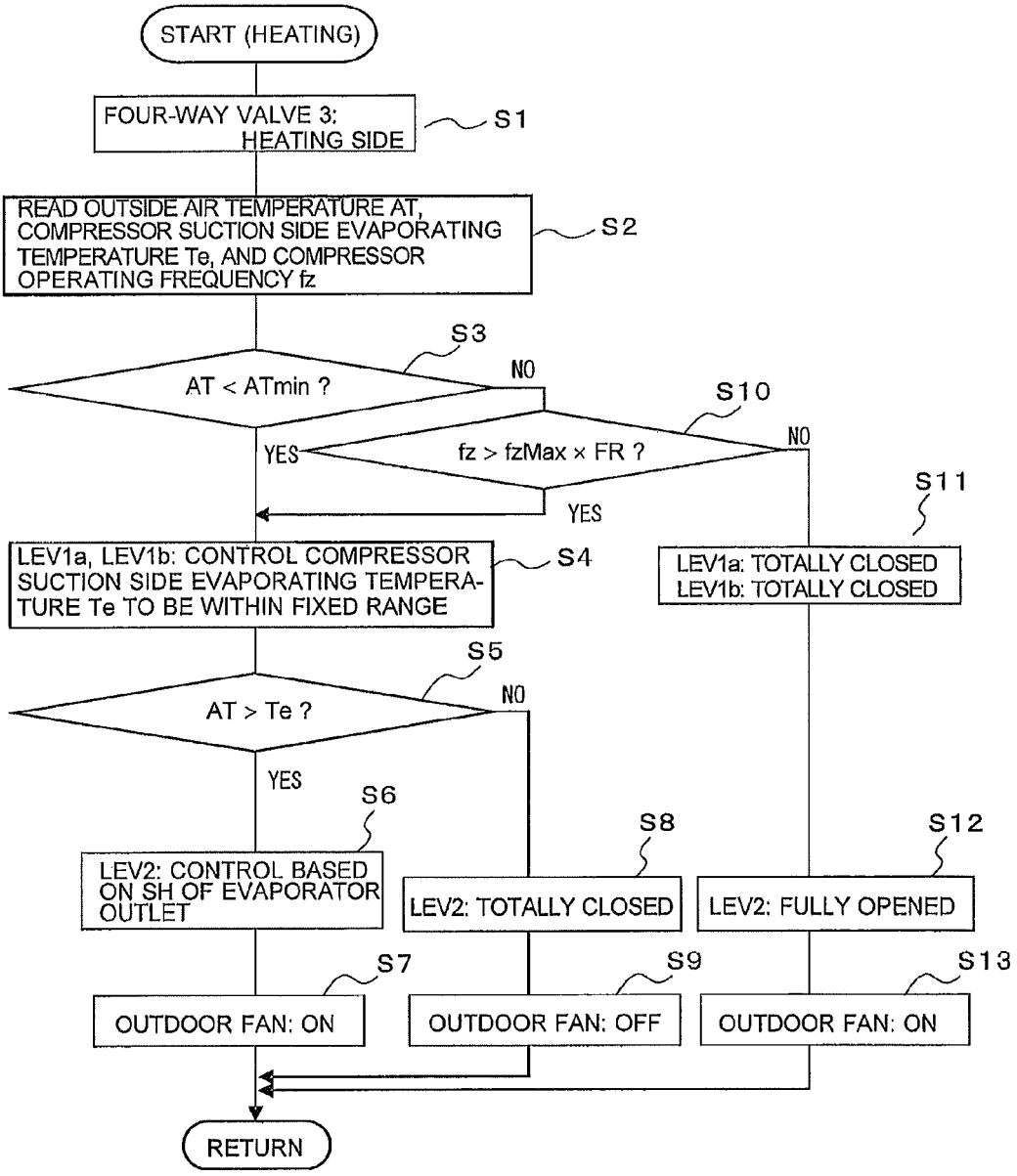
FIG. 6 is a flowchart illustrating control of a heating operation of the air-conditioning apparatus of FIG. 1.

Next, the operation of the air-conditioning apparatus of FIG. 1 during heating operation will be described with reference to the flowchart in FIG. 6. Note that control of the subsequent operation will be carried out by a controller 50 provided in the air-conditioning apparatus. Furthermore, an exemplary case will be described subsequently in which both of the indoor heat exchangers 5*a* and 5*b* are used in heating.

When a heating operation is set to the indoor heat exchangers 5*a* and 5*b*, the four-way valve 3 is switched to the heating side (S1).

Next, an outdoor air temperature AT is read from the temperature sensor TH7 and a compressor suction side evaporating temperature Te, which has been converted from a detection value of the low-pressure sensor 63LS, is read, as well as an operating frequency fz of the compressor 1 (S2).

The read outdoor air temperature AT is compared with a preset temperature ATmin (S3). ATmin is a preset temperature that is equal to or above an outdoor air temperature that hinders normal operation control of the air-conditioning apparatus due to the increase of the discharge temperature of the compressor caused by drop of low pressure. If AT is lower than ATmin, the opening degrees of the expansion valves LEV1*a* and LEV1*b* of the first bypass 22*a* and the second bypass 22*b* are controlled such that the compressor suction side evaporating temperature Te is within a fixed range (from 2 to 11 degrees C., for example) (S4).

Figure 5:
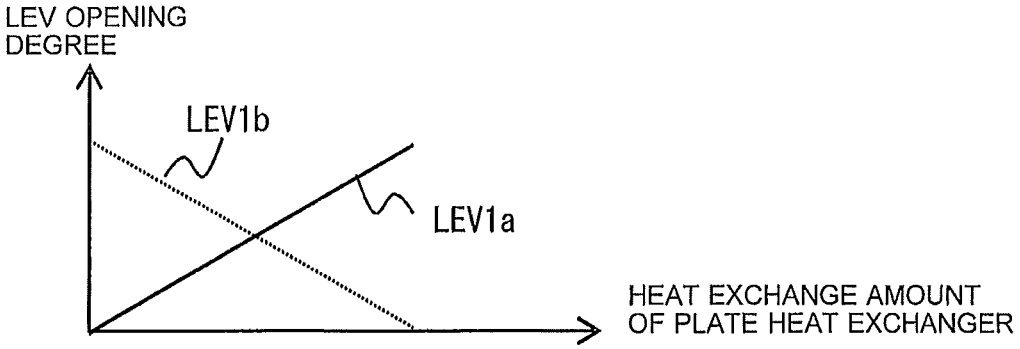
FIG. 5 is a diagram illustrating relations between opening degrees of a first bypass expansion valve LEV1*a* and a second bypass expansion valve LEV1*b* and an amount of heat exchange of an auxiliary heat exchanger 24.

As such, the refrigerant from the indoor units 200 passes through the first bypass 22*a* and the second bypass 22*b* in accordance with the opening degrees of the expansion valves LEV1*a* and LEV1*b*. At this time, the refrigerant passing through the first bypass 22*a* is heated in the auxiliary heat exchanger 24 by exchanging heat with the water heated in the boiler 51. As shown in FIG. 5, the amount of heat exchange in the auxiliary heat exchanger 24 increases in accordance with the increase in the opening degree of the expansion valve LEV1*a* and decreases in accordance with the increase in the opening degree of the expansion valve LEV1*b*. Note that the refrigerant that has passed through the first bypass 22*a* and the second bypass 22*b* returns to the compressor 1 through the merging bypass 23, the bypass extension piping 19, and the inlet bypass 29 of the outdoor unit 100.

Next, whether to use the outdoor heat exchanger 12 will be determined. That is, the outdoor air temperature AT and the compressor suction side evaporating temperature Te are compared (S5), and if AT is higher than Te, the liquid piping expansion valve LEV2 is opened and the refrigerant is also made to flow into the outdoor heat exchanger 12 so that the outdoor heat exchanger 12 is used as an evaporator. In this case, the opening degree of the liquid piping expansion valve LEV2 is controlled on the basis of the degree of superheat SH of the refrigerant (detected by the temperature sensor TH5) in the outlet of the outdoor heat exchanger 12 (S6), and the outdoor fan 14 is operated (S7). The refrigerant that has left the outdoor heat exchanger 12 returns to the compressor 1 through the four-way valve 3 and the check valve CV1.

On the other hand, if AT is equal to or lower than Te in step S5, the liquid piping expansion valve LEV2 is totally closed so as to forbid the refrigerant to flow into the outdoor heat exchanger 12 (S8), and the outdoor fan 14 is stopped (S9). That is, if the outdoor air temperature AT is equal to or lower than the compressor suction side evaporating temperature Te, the outdoor heat exchanger 12 is not used and only the auxiliary heat exchanger 24 is used as the evaporator, and a heating operation in which a heat source of the boiler 51 is used is carried out. At this time, the check valve CV1 acts to prevent the refrigerant from stagnating in the outdoor heat exchanger 12.

Furthermore, in step S3, if the outdoor air temperature AT is equal to or higher than ATmin, the degree of margin of the operating capacity of the compressor 1 is determined from the operating frequency fz of the compressor 1 (S10). That is, the operating frequency fz of the compressor 1 is compared with the value obtained by multiplying a threshold value FR, which is set as a ratio of usage of the external heat source, to the maximum operating frequency fzMax of the compressor 1, and if fz>fxMax×FR, then it is determined that there is no margin in the driving capacity of the compressor 1, and the control proceeds to step S4 in which the auxiliary heat exchanger 24 is used. On the other hand, if fz is equal to or less than fzMax×FR, then there is some margin in the driving capacity of the compressor 1, and a heating operation without using the auxiliary heat exchanger 24 is carried out. That is, the heating operation is carried out such that each of the expansion valves LEV1*a* and LEV1*b* of the first bypass 22*a* and the second bypass 22*b* is totally closed (S11), the liquid piping expansion valve LEV2 is fully opened (S12), and the outdoor heat exchanger 12 and the outdoor fan 14 are operated (S13).

Note that although the threshold value FR may be set as appropriate, here, it is "0.9". This threshold value FR is applied to the other Embodiments in the same manner.

The air-conditioning apparatus of Embodiment 1 obtains advantageous effects described below. Since an auxiliary heat exchanger that utilizes a heat source different from the refrigerant heat source of the refrigeration cycle is provided, continuous heating operation can be carried out even under a low outdoor air temperature environment where the air-conditioning apparatus is not operable. Furthermore, since the refrigerant evaporating temperature in the refrigeration cycle increases, the amount of refrigerant circulation increases and the heating capacity increases. Additionally, since the outdoor air temperature AT and the evaporating temperature Te are compared, the outdoor heat exchanger 12 can be effectively utilized during a heating operation under a low outdoor temperature environment.

Note that in the cooling operation of the air-conditioning apparatus of Embodiment 1, the refrigerant circulates in a refrigerant circuit in which each of the bypass expansion valves LEV1*a* and LEV1*b* is totally closed and the four-way valve 3 is connected to the cooling side. That is, the refrigerant circulates in the order of the compressor 1, the outdoor heat exchanger 12, the liquid piping expansion valve LEV2, the indoor expansion valves 7*a* and 7*b*, the indoor heat exchangers 5*a* and 5*b*, the four-way valve 3, the check valve CV1, and the compressor 1. As such, a conditioned space is cooled with the indoor heat exchangers 5*a* and 5*b*.

Embodiment 2

Figure 2:
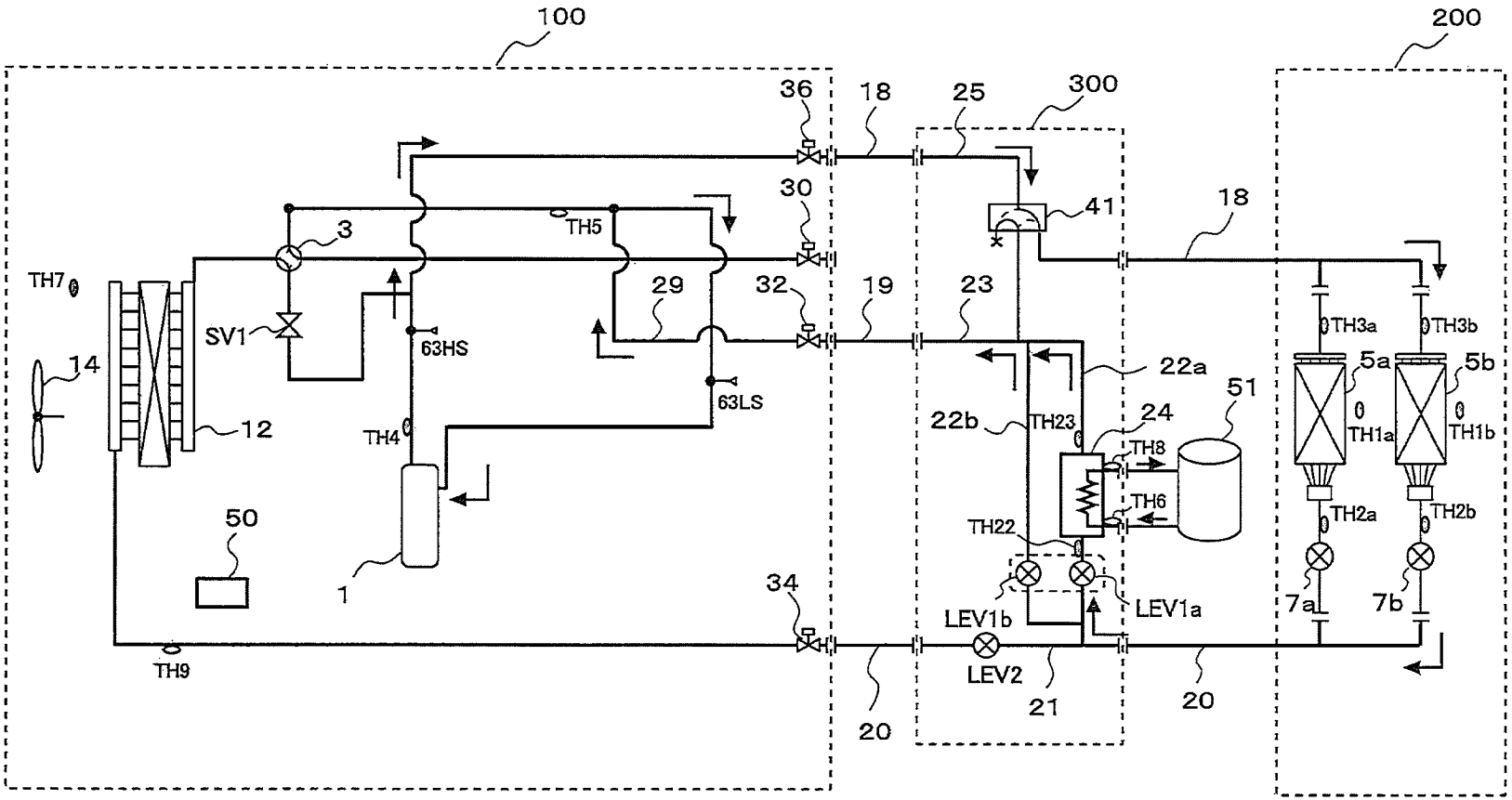
FIG. 2 is a block diagram of an air-conditioning apparatus illustrating Embodiment 2 of the invention.

Next, an air-conditioning apparatus of Embodiment 2 of the invention will be described with reference to FIG. 2. FIG. 2 is an air-conditioning apparatus capable of switching between a heating operation and a cooling operation. As illustrated in FIG. 2, a refrigerant circuit of a refrigeration cycle is formed by a compressor 1, a four-way valve 41 serving as a flow switching device of indoor units to cooling/heating, indoor heat exchangers 5*a* and 5*b*, indoor expansion valves 7*a* and 7*b*, a liquid piping expansion valve LEV2, an outdoor heat exchanger 12, and a four-way valve 3. Note that the arrows in FIG. 2 indicate a refrigerant flow in a heating operation in which the outdoor heat exchanger 12 is not used.

The compressor 1, the four-way valve 3, and the outdoor heat exchanger 12 are disposed in an outdoor unit 100. The outdoor unit 100 is provided with a temperature sensor TH4 that detects a temperature of the refrigerant discharged from the compressor 1, a high-pressure sensor 63HS that detects a pressure of the refrigerant discharged from the compressor 1, a solenoid valve SV1 that is an on-off valve provided in a passage between the discharge side of the compressor 1 and the four-way valve 3, a temperature sensor TH5 that detects a temperature of the refrigerant that has left the four-way valve 3 towards an inlet of the compressor 1, and a low-pressure sensor 63LS that detects a pressure of the refrigerant on a suction side of the compressor 1. The outdoor unit 100 is further provided with an outdoor fan 14 that blows air to the outdoor heat exchanger 12, a temperature sensor TH7 that detects a temperature of air (outdoor air) that exchanges heat in the outdoor heat exchanger 12, and a temperature sensor TH9 that detects a temperature of the refrigerant flowing into the outdoor heat exchanger 12 during the heating operation (or a temperature of the refrigerant flowing out of the outdoor heat exchanger 12 during the cooling operation).

Furthermore, the outdoor unit 100 is provided with an inlet bypass 29 that branches off from between the four-way valve 3 and the inlet of the compressor 1 reaching an inlet port 32. This inlet bypass 29 is connected to an additional unit 300 described below through a bypass extension piping 19 that is connected to the inlet port 32.

The indoor heat exchangers 5*a* and 5*b* and the indoor expansion valves 7*a* and 7*b* constitute indoor units 200. The indoor units 200 are provided with temperature sensors TH1*a* and TH1*b* that each detect a temperature of suction air that exchanges heat in the indoor heat exchangers 5*a* and 5*b*, respectively, and temperature sensors TH2*a*, TH2*b*, TH3*a*, and TH3*b* that each detects a temperature of the refrigerant before or after the indoor heat exchangers 5*a* or 5*b*. Note that the number of indoor heat exchangers is not limited to two and any appropriate number may be allowed. Each indoor heat exchanger may air condition different spaces or may air condition the same space.

The outdoor unit 100 and the indoor units 200 are connected through a gas extension piping 18 and a liquid extension piping 20. Note that the gas extension piping 18 is connected to a discharge port 36 of the outdoor unit 100 and the liquid extension piping 20 is connected to a suction/discharge port 34 of the outdoor unit 100.

The additional unit 300 is provided between the outdoor unit 100 and the indoor units 200. The additional unit 300 is provided with a unit liquid piping 21 constituting a portion of the liquid extension piping 20, the liquid piping expansion valve LEV2 that is provided in the unit liquid piping 21, a first bypass 22*a* and a second bypass 22*b* that are parallel passages branched off from the passage between the liquid piping expansion valve LEV2 and the indoor units 200, a first bypass expansion valve LEV1*a* and a second bypass expansion valve LEV1*b* provided in each bypass, and an auxiliary heat exchanger 24 disposed in the first bypass 22*a* in series with the expansion valve LEV1*a*. The auxiliary heat exchanger 24 exchanges heat between a refrigerant flowing in the first bypass 22*a* and a heat medium, such as water (hereinafter, referred to as "water"), heated with an external heat source (a heat source different from the refrigerant), such as a boiler 51, and includes a plate heat exchanger, for example. Temperature sensors TH22 and TH23 that detect refrigerant temperatures are provided in the refrigerant inlet and outlet of the auxiliary heat exchanger 24 in the first bypass 22*a*. Temperature sensors TH6 and TH8 that detect water temperatures in their respective positions are further provided in the water inlet and outlet of the auxiliary heat exchanger 24. The first bypass 22*a* and the second bypass 22*b* are connected to the inlet port 32 of the outdoor unit 100 through a merging bypass 23 and the bypass extension piping 19.

The additional unit 300 is further provided with the four-way valve 41 that serves as a switching device of the passages between the cooling operation and the heating operation of the indoor units 200. The four-way valve 41 switches passages between a unit gas piping 25 connected to the gas extension piping 18, the gas extension piping 18 connected to the indoor units 200, and the merging bypass 23 connected to the bypass extension piping 19.

Figure 7:
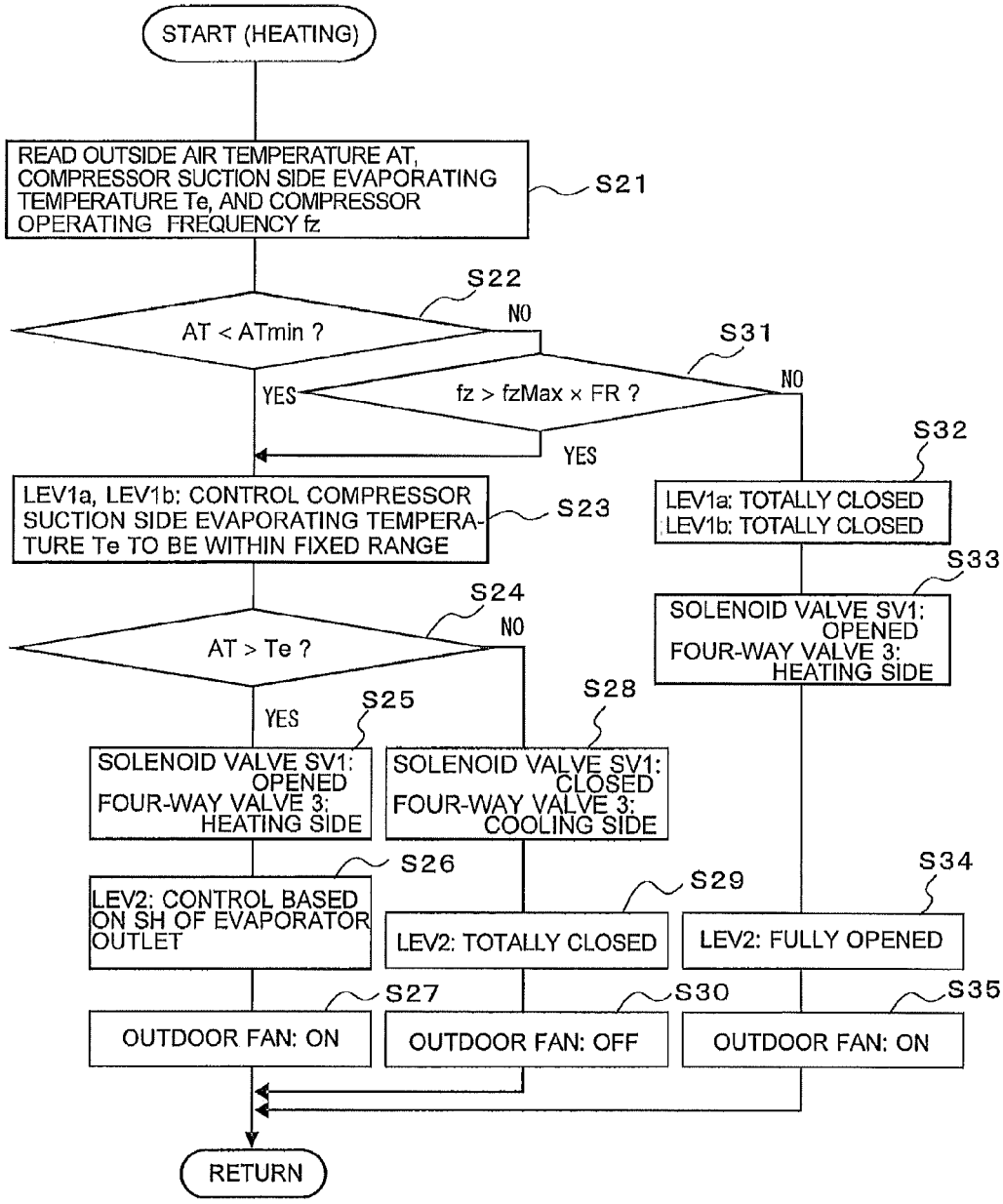
FIG. 7 is a flowchart illustrating control of a heating operation of the air-conditioning apparatus of FIG. 2.

Next, the operation of the air-conditioning apparatus of FIG. 2 during heating operation will be described with reference to the flowchart in FIG. 7. Note that control of the subsequent operation will be carried out by a controller 50 provided in the air-conditioning apparatus. Furthermore, an exemplary case will be described subsequently in which both of the indoor heat exchangers 5*a* and 5*b* are used in heating.

When a heating operation is set to the indoor heat exchangers 5*a* and 5*b*, first, the four-way valve 3 and the four-way valve 41 are switched to the heating side.

Next, an outdoor air temperature AT is read from the temperature sensor TH7 and a compressor suction side evaporating temperature Te, which has been converted from a detection value of the low-pressure sensor 63LS, is read, as well as an operating frequency fz of the compressor 1 (S21).

The read outdoor air temperature AT is compared with a preset temperature ATmin (S22). ATmin is a preset temperature that is equal to or above an outdoor air temperature that hinders normal operation control of the air-conditioning apparatus due to the increase of the discharge temperature of the compressor caused by drop of low pressure. If AT is lower than ATmin, the opening degrees of the expansion valves LEV1*a* and LEV1*b* of the first bypass 22*a* and the second bypass 22*b* are controlled such that the compressor suction side evaporating temperature Te is within a fixed range (from 2 to 11 degrees C., for example) (S23).

As such, the refrigerant from the indoor units 200 passes through the first bypass 22*a* and the second bypass 22*b* in accordance with the opening degrees of the expansion valves LEV1*a* and LEV1*b*. At this time, the refrigerant passing through the first bypass 22*a* is heated in the auxiliary heat exchanger 24 by exchanging heat with the water heated in the boiler 51. As shown in FIG. 5, the amount of heat exchange in the auxiliary heat exchanger 24 increases in accordance with the increase in the opening degree of the expansion valve LEV1*a* and decreases in accordance with the increase in the opening degree of the expansion valve LEV1*b*. Note that the refrigerant that has passed through the first bypass 22*a* and the second bypass 22*b* returns to the compressor 1 through the merging bypass 23, the bypass extension piping 19, and the inlet bypass 29 of the outdoor unit 100.

Next, whether to use the outdoor heat exchanger 12 will be determined. The outdoor air temperature AT and the compressor suction side evaporating temperature Te are compared (S24), and if AT is higher than Te, the solenoid valve SV1 is opened and the four-way valve 3 is switched to the heating side (S25). That is, the refrigerant is also made to flow into the outdoor heat exchanger 12 so that the outdoor heat exchanger 12 is used as an evaporator. In this case, the opening degree of the liquid piping expansion valve LEV2 is controlled on the basis of the degree of superheat SH of the refrigerant (detected by the temperature sensor TH5) in the outlet of the outdoor heat exchanger 12 (S26), and the outdoor fan 14 is operated (S27). The refrigerant that has left the outdoor heat exchanger 12 returns to the compressor 1 through the four-way valve 3.

On the other hand, if AT is equal to or lower than Te in step S24, the solenoid valve SV1 is closed, the four-way valve 3 is switched to the cooling side (S28), the liquid piping expansion valve LEV2 is totally closed (S29) so as to forbid the refrigerant to flow into the outdoor heat exchanger 12, and the outdoor fan 14 is stopped (S30). That is, if the outdoor air temperature AT is equal to or lower than the compressor suction side evaporating temperature Te, the outdoor heat exchanger 12 is not used and only the auxiliary heat exchanger 24 is used as the evaporator, and a heating operation in which a heat source of the boiler 51 is used is carried out. At this time, the solenoid valve SV1 acts to prevent the refrigerant from stagnating in the outdoor heat exchanger 12.

Furthermore, in step S22, if AT is equal to or higher than ATmin, the degree of margin of the operating capacity of the compressor 1 is determined from the operating frequency fz of the compressor 1 (S31). That is, the operating frequency fz of the compressor 1 is compared with the value obtained by multiplying a threshold value FR, which is set as a ratio of usage of the external heat source, to the maximum operating frequency fzMax of the compressor 1, and if fz>fxMax×FR, then it is determined that there is no margin in the driving capacity of the compressor 1, and the control proceeds to step S23 in which the auxiliary heat exchanger 24 is used. On the other hand, if fz is equal to or less than fzMax×FR, as it is determined that there is some margin in the driving capacity of the compressor 1, a heating operation without using the auxiliary heat exchanger 24 is carried out. That is, the heating operation is carried out such that each of the expansion valves LEV1*a* and LEV1*b* of the first bypass 22*a* and the second bypass 22*b* is totally closed (S32), the solenoid valve SV1 is opened, the four-way valve 3 is switched to the heating side (S33), the liquid piping expansion valve LEV2 is fully opened (S34), and the outdoor heat exchanger 12 and the outdoor fan 14 are operated (S35).

The air-conditioning apparatus of Embodiment 2 obtains the same advantageous effects as that described in Embodiment 1. In addition to that, in Embodiment 2, since there is no check valve CV1 that is provided in Embodiment 1 causing pressure loss due to low pressure, capacity is increased to this extent compared to that of Embodiment 1.

Note that in the cooling operation of the air-conditioning apparatus of Embodiment 2, the refrigerant circulates in a refrigerant circuit in which each of the bypass expansion valves LEV1*a* and LEV1*b* is totally closed and the four-way valve 3 and the four-way valve 41 are connected to the cooling side. That is, the refrigerant circulates in the order of the compressor 1, the solenoid valve SV1, the outdoor heat exchanger 12, the liquid piping expansion valve LEV2, the indoor expansion valves 7*a* and 7*b*, the indoor heat exchangers 5*a* and 5*b*, the four-way valve 41, the merging bypass 23, the bypass extension piping 19, inlet bypass 29, and the compressor 1. As such, a conditioned space is cooled with the indoor heat exchangers 5*a* and 5*b*.

Embodiment 3

Figure 3:
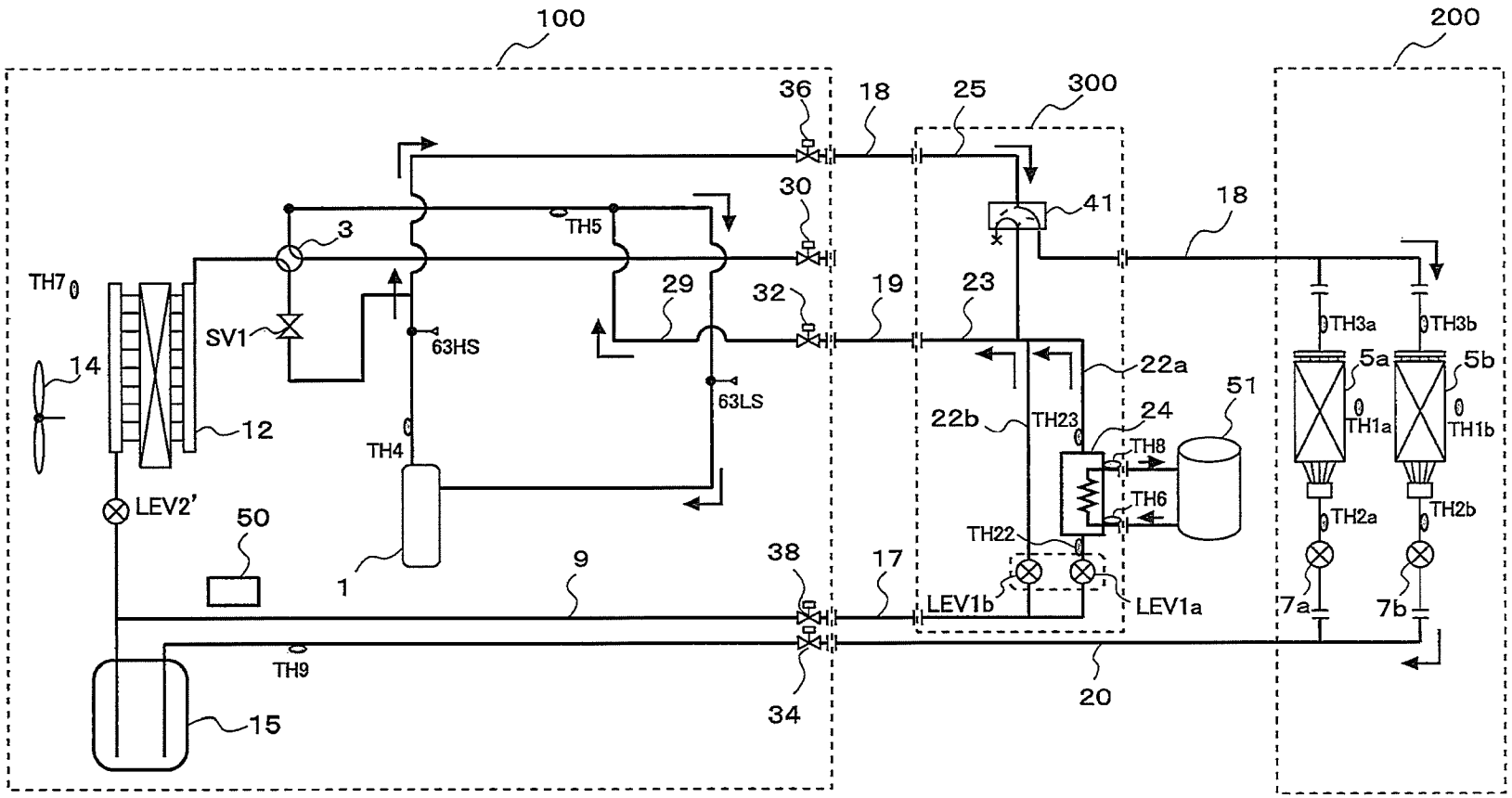
FIG. 3 is a block diagram of an air-conditioning apparatus illustrating Embodiment 3 of the invention.

Next, an air-conditioning apparatus of Embodiment 3 of the invention will be described with reference to FIG. 3. FIG. 3 is an air-conditioning apparatus capable of switching between a heating operation and a cooling operation. As illustrated in FIG. 3, a refrigerant circuit of a refrigeration cycle is formed by a compressor 1, a four-way valve 41 serving as a flow switching device of indoor units 200 to cooling/heating, indoor heat exchangers 5*a* and 5*b*, indoor expansion valves 7*a* and 7*b*, a receiver 15, an outdoor expansion valve LEV2', an outdoor heat exchanger 12, and a four-way valve 3. Note that the arrows in FIG. 3 indicate a refrigerant flow in a heating operation in which the outdoor heat exchanger 12 is not used.

The compressor 1, the four-way valve 3, the outdoor heat exchanger 12, the outdoor expansion valve LEV2', and the receiver 15 are disposed in an outdoor unit 100. The outdoor unit 100 is provided with a temperature sensor TH4 that detects a temperature of the refrigerant discharged from the compressor 1, a high-pressure sensor 63HS that detects a pressure of the refrigerant discharged from the compressor 1, a solenoid valve SV1 that is an on-off valve provided in a passage between the discharge side of the compressor 1 and the four-way valve 3, a temperature sensor TH5 that detects a temperature of the refrigerant that has left the four-way valve 3 towards the suction side of the compressor 1, and a low-pressure sensor 63LS that detects a pressure of the refrigerant on a suction side of the compressor 1. The outdoor unit 100 is further provided with an outdoor fan 14 that blows air to the outdoor heat exchanger 12, a temperature sensor TH7 that detects a temperature of air (outdoor air) that exchanges heat in the outdoor heat exchanger 12, and a temperature sensor TH9 that detects a temperature of the refrigerant flowing into the outdoor heat exchanger 12 during the heating operation (or a temperature of the refrigerant flowing out of the outdoor heat exchanger 12 during the cooling operation).

The outdoor unit 100 is furthermore provided with an inlet bypass 29 that is branched off from a passage between the four-way valve 3 and a suction side of the compressor 1 reaching an inlet port 32 and an intermediate-pressure bypass 9 branching off from a passage between the receiver 15 and the outdoor heat exchanger 12 reaching an intermediate-pressure port 38. The inlet port 32 and the intermediate-pressure port 38 are connected to an additional unit 300 described below through a bypass extension piping 19 and an intermediate-pressure extension piping 17, respectively.

The indoor heat exchangers 5*a* and 5*b* and the indoor expansion valves 7*a* and 7*b* constitute indoor units 200. The indoor units 200 are provided with temperature sensors TH1*a* and TH1*b* that each detect a temperature of suction air that exchanges heat in the indoor heat exchangers 5*a* and 5*b*, respectively, and temperature sensors TH2*a*, TH2*b*, TH3*a*, and TH3*b* that each detects a temperature of the refrigerant before or after the indoor heat exchangers 5*a* or 5*b*. Note that the number of indoor heat exchangers is not limited to two and any appropriate number may be allowed. Each indoor heat exchanger may air condition different spaces or may air condition the same space.

The outdoor unit 100 and the indoor units 200 are connected through a gas extension piping 18 and a liquid extension piping 20. Note that the gas extension piping 18 is connected to a discharge port 36 of the outdoor unit 100 and the liquid extension piping 20 is connected to a suction/discharge port 34 of the outdoor unit 100.

The additional unit 300 is provided between the outdoor unit 100 and the indoor units 200. The additional unit 300 is provided with a first bypass 22*a* and a second bypass 22*b* that are connected to the intermediate-pressure port 38 of the outdoor unit 100 through the intermediate-pressure extension piping 17. Furthermore, the additional unit 300 is provided with a first bypass expansion valve LEV1*a* and a second bypass expansion valve LEV1*b* provided in each bypass, and an auxiliary heat exchanger 24 disposed in the first bypass 22*a* in series with the expansion valve LEV1*a*. The auxiliary heat exchanger 24 exchanges heat between a refrigerant flowing in the first bypass 22*a* and a heat medium, such as water (hereinafter, referred to as "water"), heated with an external heat source (a heat source different from the refrigerant), such as a boiler 51, and includes a plate heat exchanger, for example. Temperature sensors TH22 and TH23 that detect refrigerant temperatures are provided in the refrigerant inlet and outlet of the auxiliary heat exchanger 24 in the first bypass 22*a*. Temperature sensors TH6 and TH8 that detect water temperatures in their respective positions are further provided in the water inlet and outlet of the auxiliary heat exchanger 24. Note that the first bypass 22*a* and the second bypass 22*b* are connected to the inlet port 32 of the outdoor unit 100 through a merging bypass 23 and the bypass extension piping 19.

The additional unit 300 is further provided with the four-way valve 41 that serves as a switching device of the passages between the cooling operation and the heating operation of the indoor units 200. The four-way valve 41 switches passages between a unit gas piping 25 connected to the gas extension piping 18, the gas extension piping 18 connected to the indoor units 200, and the merging bypass 23 connected to the bypass extension piping 19.

Figure 8:
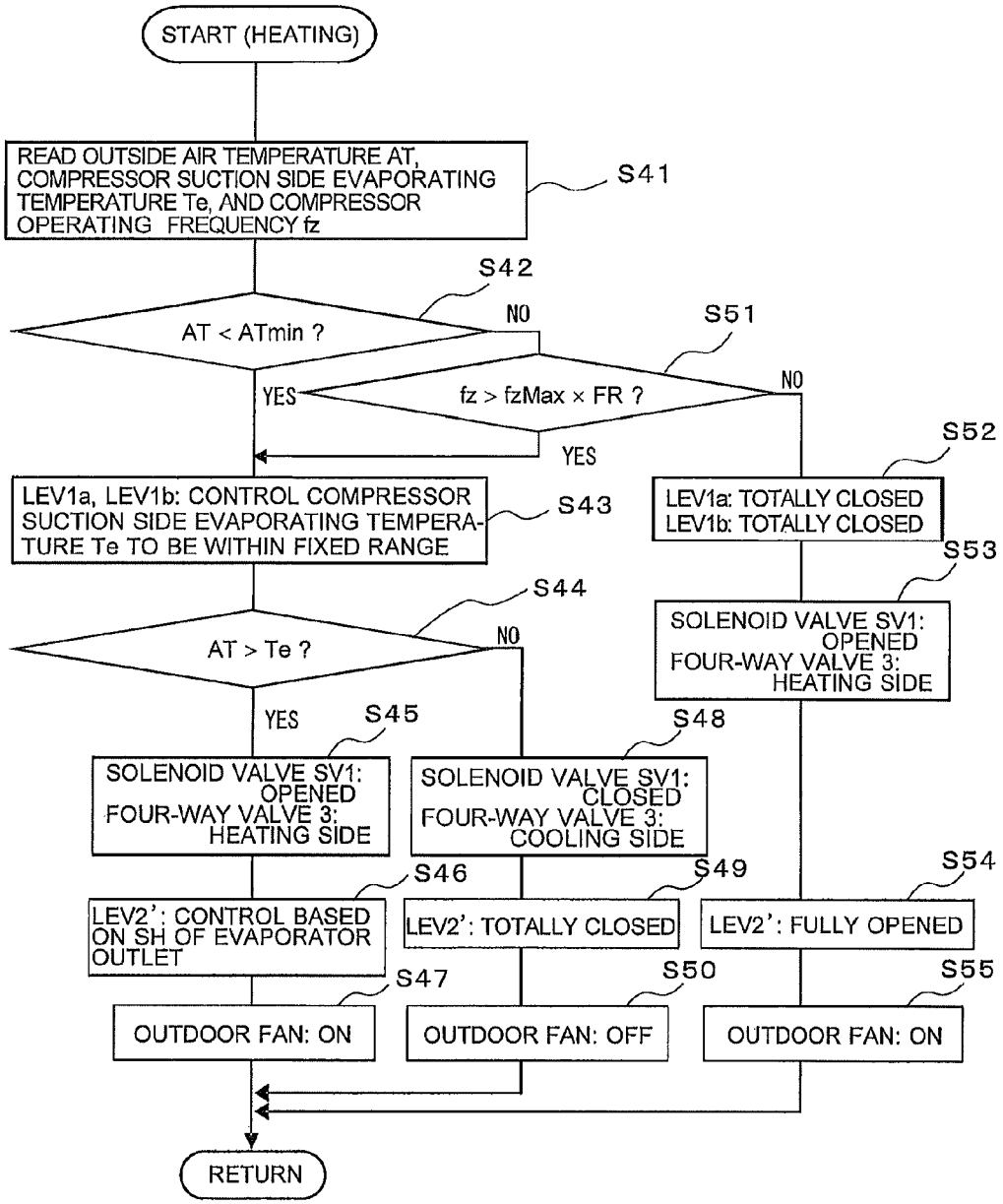
FIG. 8 is a flowchart illustrating control of a heating operation of the air-conditioning apparatus of FIG. 3.

Next, the operation of the air-conditioning apparatus of FIG. 3 during heating operation will be described with reference to the flowchart in FIG. 8. Note that control of the subsequent operation will be carried out by a controller 50 provided in the air-conditioning apparatus. Furthermore, an exemplary case will be described subsequently in which both of the indoor heat exchangers 5*a* and 5*b* are used in heating.

When a heating operation is set to the indoor heat exchangers 5*a* and 5*b*, first, the four-way valve 3 and the four-way valve 41 are switched to the heating side.

Next, an outdoor air temperature AT is read from the temperature sensor TH7 and a compressor suction side evaporating temperature Te, which has been converted from a detection value of the low-pressure sensor 63LS, is read, as well as an operating frequency fz of the compressor 1 (S41).

The read outdoor air temperature AT is compared with a preset temperature ATmin (S42). ATmin is a preset temperature that is equal to or above an outdoor air temperature that hinders normal operation control of the air-conditioning apparatus due to the increase of the discharge temperature of the compressor caused by drop of low pressure. If AT is lower than ATmin, the opening degrees of the expansion valves LEV1*a* and LEV1*b* of the first bypass 22*a* and the second bypass 22*b* are controlled such that the compressor suction side evaporating temperature Te is within a fixed range (from 2 to 11 degrees C., for example) (S43).

As such, the refrigerant from the receiver 15 passes through the first bypass 22*a* and the second bypass 22*b* in accordance with the opening degrees of the expansion valves LEV1*a* and LEV1*b*. At this time, the refrigerant passing through the first bypass 22*a* is heated in the auxiliary heat exchanger 24 by exchanging heat with the water heated in the boiler 51. As shown in FIG. 5, the amount of heat exchange in the auxiliary heat exchanger 24 increases in accordance with the increase in the opening degree of the expansion valve LEV1*a* and decreases in accordance with the increase in the opening degree of LEV1*b*. Note that the refrigerant that has passed through the first bypass 22*a* and the second bypass 22*b* returns to the compressor 1 through the merging bypass 23, the bypass extension piping 19, and the inlet bypass 29 of the outdoor unit 100.

Next, whether to use the outdoor heat exchanger 12 will be determined. That is, the outdoor air temperature AT and the compressor suction side evaporating temperature Te are compared (S44), and if AT is higher than Te, the solenoid valve SV1 is opened and the four-way valve 3 is switched to the heating side (S45). In other words, the refrigerant is also made to flow into the outdoor heat exchanger 12 so that the outdoor heat exchanger 12 is used as an evaporator. In this case, the opening degree of the outdoor expansion valve LEV2' is controlled on the basis of the degree of superheat SH of the refrigerant (detected by the temperature sensor TH5) in the outlet of the outdoor heat exchanger 12 (S46), and the outdoor fan 14 is operated (S47). The refrigerant that has left of the outdoor heat exchanger 12, subsequently, returns to the compressor 1 through the four-way valve 3.

On the other hand, if AT is equal to or lower than Te in step S44, the solenoid valve SV1 is closed, the four-way valve 3 is switched to the cooling side (S48), the outdoor expansion valve LEV2' is totally closed (S49) so as to forbid the refrigerant to flow into the outdoor heat exchanger 12, and the outdoor fan 14 is stopped (S50). That is, if the outdoor air temperature AT is equal to or lower than the compressor suction side evaporating temperature Te, the outdoor heat exchanger 12 is not used and only the auxiliary heat exchanger 24 is used as the evaporator, and a heating operation in which a heat source of the boiler 51 is used is carried out. At this time, the solenoid valve SV1 acts to prevent the refrigerant from stagnating in the outdoor heat exchanger 12.

Furthermore, in step S42, if AT is equal to or higher than ATmin, the degree of margin of the operating capacity of the compressor 1 is determined from the operating frequency fz of the compressor 1 (S51). That is, the operating frequency fz of the compressor 1 is compared with the value obtained by multiplying a threshold value FR, which is set as a ratio of usage of the external heat source, to the maximum operating frequency fzMax of the compressor 1, and if fz>fxMax×FR, then it is determined that there is no margin in the driving capacity of the compressor 1, and the control proceeds to step S43 in which the auxiliary heat exchanger 24 is used. On the other hand, if fz is equal to or less than fzMax×FR, as it is determined that there is some margin in the driving capacity of the compressor 1, a heating operation without using the auxiliary heat exchanger 24 is carried out. That is, the heating operation is carried out such that each of the expansion valves LEV1*a* and LEV2*b* of the first bypass 22*a* and the second bypass 22*b* is totally closed (S52), the solenoid valve SV1 is opened, the four-way valve 3 is switched to the heating side (S53), the outdoor expansion valve LEV2' is fully opened (S54), and the outdoor heat exchanger 12 and the outdoor fan 14 are operated (S55).

The air-conditioning apparatus of Embodiment 3 obtains the same advantageous effects as that described in Embodiment 1. In addition to that, in Embodiment 3, since there is no check valve CV1 that is disposed in Embodiment 1 causing pressure loss due to low pressure, capacity is increased to this extent compared to that of Embodiment 1. Furthermore, since it will be possible to retain different amounts of excess refrigerant in the receiver 15 corresponding to the operation state, capacity is increased compared to Embodiment 2.

Note that in the cooling operation of the air-conditioning apparatus of Embodiment 3, the refrigerant circulates in a refrigerant circuit in which each of the bypass expansion valves LEV1*a* and LEV1*b* is totally closed and the four-way valve 3 and the four-way valve 41 are connected to the cooling side. That is, the refrigerant circulates in the order of the compressor 1, the solenoid valve SV1, the outdoor heat exchanger 12, the outdoor expansion valve LEV2', the indoor expansion valves 7*a* and 7*b*, the indoor heat exchangers 5*a* and 5*b*, the four-way valve 41, the merging bypass 23, the bypass extension piping 19, inlet bypass 29, and the compressor 1. As such, a conditioned space is cooled with the indoor heat exchangers 5*a* and 5*b*.

Embodiment 4

Next, an air-conditioning apparatus of Embodiment 4 of the invention will be described with reference to FIG. 4. The air-conditioning apparatus of FIG. 4 includes an outdoor unit 100A, indoor units 200A, a flow dividing controller 400A, and an additional unit 300A, and is a type of air-conditioning apparatus that is capable of carrying out heating operation and cooling operation simultaneously. In this air-conditioning apparatus, the outdoor unit 100A and the flow dividing controller 400A are connected with two pipings, that is, a high-pressure side piping 60 and a low-pressure side piping 61, and the flow dividing controller 400A and each indoor heat exchangers 5*a* and 5*b* are connected with two pipings, that is, a gas branch piping 67 and a liquid branch piping 68.

Figure 4:
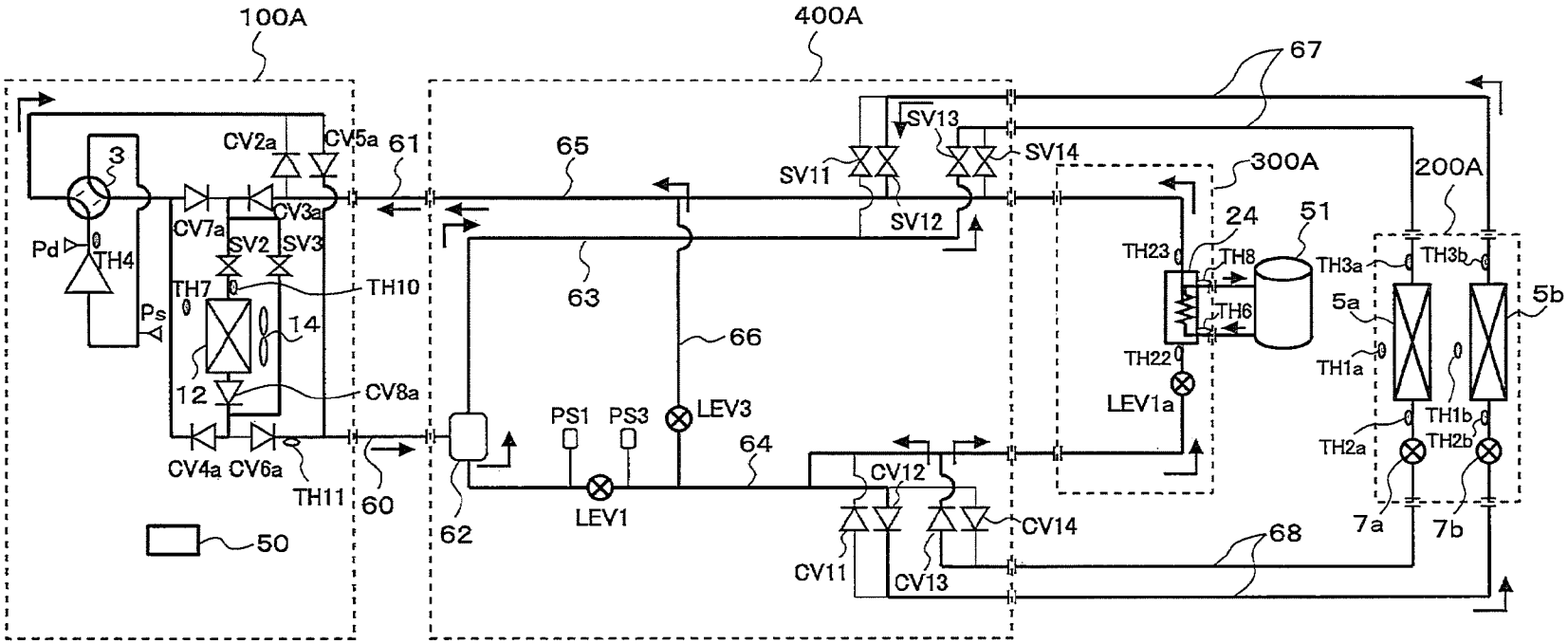
FIG. 4 is a block diagram of an air-conditioning apparatus illustrating Embodiment 4 of the invention.

The air-conditioning apparatus of FIG. 4 is provided, as its operation mode, a heating only operation mode in which all of the operating indoor heat exchangers carry out a heating operation, a cooling only operation mode in which all of the operating indoor heat exchangers carry out a cooling operation, a heating main operation mode in which a heating operation and a cooling operation co-exist and in which a heating load is larger than a cooling load, and a cooling main operation mode in which a heating operation and a cooling operation co-exist and in which a cooling load is larger than a heating load. The arrows in FIG. 4 indicate a refrigerant flow in a heating main operation in which the outdoor heat exchanger 12 is not used.

The outdoor unit 100A is provided with a compressor 1, a four-way valve 3 serving as a flow switching device, and an outdoor heat exchanger 12. The outdoor unit 100A is further provided with check valves CV2*a*, CV3*a*, CV4*a*, CV5*a*, CV6*a*, CV7*a*, and CV8*a* that each regulates the refrigerant to flow in only one direction and solenoid valves (on-off valves) SV2 and SV3 that regulate the refrigerant to flow through the outdoor heat exchanger 12 or to bypass the outdoor heat exchanger 12. The outdoor unit 100A is furthermore provided with a temperature sensor TH4 that detects a temperature of the refrigerant discharged from the compressor 1, a high-pressure sensor Pd that detects a pressure of the refrigerant discharged from the compressor 1, a low-pressure sensor Ps that detects a pressure of the refrigerant entering the compressor 1, a temperature sensor TH7 that detects a temperature of air (outdoor air) that exchanges heat with the refrigerant in the outdoor heat exchanger 12, a temperature sensor TH10 that detects a temperature of the refrigerant entering the outdoor heat exchanger 12, and a temperature sensor TH11 that detects a temperature of the refrigerant leaving the outdoor unit 100A.

The indoor heat exchangers 5*a* and 5*b* and indoor expansion valves 7*a* and 7*b* constitute the indoor units 200A. Note that a single indoor heat exchanger and a single indoor expansion valve constitute a single indoor unit. Accordingly, in this case, there is an indoor unit including the indoor heat exchanger 5*a* and the indoor expansion valve 7*a* and an indoor unit including the indoor heat exchanger 5*b* and the indoor expansion valve 7*b*.

The indoor units 200A are provided with temperature sensors TH1*a* and TH1*b* that each detect a temperature of suction air that exchanges heat in the indoor heat exchangers 5*a* and 5*b*, respectively, and temperature sensors Th2*a*, TH2*b*, TH3*a*, and TH3*b* that each detects a temperature of the refrigerant in the inlet or outlet of the indoor heat exchangers 5*a* or 5*b*. Note that the number of indoor heat exchangers is not limited to two and any appropriate number may be allowed. Each indoor heat exchanger may air condition different spaces or may air condition the same space.

The flow dividing controller 400A is disposed between the outdoor unit 100A and the indoor units 200A and switches the flow of the refrigerant circulating between the outdoor unit 100A and the indoor units 200A in accordance with each operation mode.

The flow dividing controller 400A includes a gas-liquid separator 62 that is connected to the high-pressure side piping 60, a gas piping 63 in which a gas refrigerant separated in the gas-liquid separator 62 flows, a liquid piping 64 in which a liquid refrigerant separated in the gas-liquid separator 62 flows, a return piping 65 in which the refrigerant returning to the outdoor unit 100A flows. The flow dividing controller 400A includes a return bypass 66, which connects the liquid piping 64 and the return piping 65, and a return bypass expansion valve LEV3 provided midway of the return bypass 66. Furthermore, in the liquid piping 64 between the gas-liquid separator 62 and the return bypass 66, a flow-dividing-controller expansion valve LEV1 and pressure sensors PS1 and PS3 that detect the pressure of the refrigerant before and after the flow-dividing-controller expansion valve LEV1 are provided.

The flow dividing controller 400A is provided with solenoid valves SV11 to SV14, serving as on-off valves, and check valves CV11 to CV14 in order to carry out switching such that the refrigerant for heating is distributed or the refrigerant for cooling is distributed to the indoor heat exchangers 5*a* and 5*b* in accordance with the operation mode of each of the indoor heat exchangers 5*a* and 5*b* constituting the indoor units 200A. Further, the flow dividing controller 400A and each of the indoor units are connected through respective solenoid valves SV11 to SV14 and check valves CV11 to CV14.

The additional unit 300A is connected to the flow dividing controller 400A, in parallel with the indoor units 200A. The additional unit 300A is provided with a refrigerant passage, an expansion valve (a first bypass expansion valve) LEV1*a* provided in the passage, and an auxiliary heat exchanger 24 that exchanges heat between the refrigerant that has passed through the expansion valve LEV1*a* and a heat medium, such as water (hereinafter, referred to as "water"), heated with an external heat source different from the refrigerant, such as a boiler 51. The auxiliary heat exchanger 24 is a plate heat exchanger, for example. The amount of heat exchanged by the auxiliary heat exchanger 24 can be controlled by the expansion valve LEV1*a* of the additional unit 300A and the return bypass expansion valve LEV3 provided in the return bypass 66 in conformity to FIG. 5 (equivalent to substituting LEV1*b* in FIG. 5 with LEV3). Note that the additional unit 300A is used when all of the indoor heat exchangers constituting the indoor units are in heating operation (during heating only operation) or when the heating load is larger while a heating operation and cooling operation co-exists in the indoor heat exchangers (during heating main operation), and that, at this time, the additional unit 300A functions like an indoor heat exchanger in cooling operation.

Figure 9:
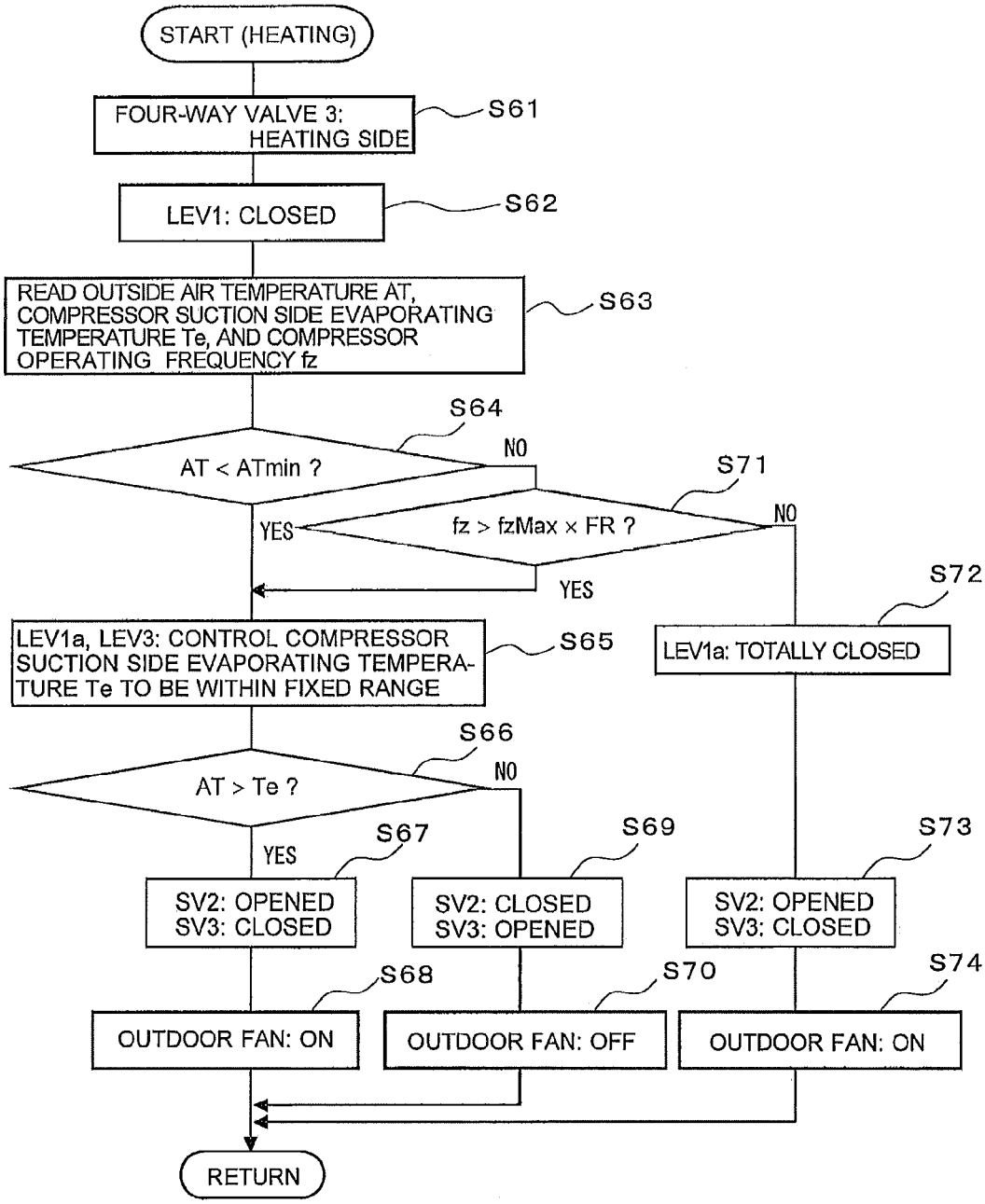
FIG. 9 is a flowchart illustrating control of a heating operation of the air-conditioning apparatus of FIG. 4.

Next, the operation of the air-conditioning apparatus of FIG. 4 will be described with reference to the flowchart in FIG. 9. Note that control of the subsequent operation will be carried out by a controller 50 provided in the air-conditioning apparatus. Further, a heating main operation will be described subsequently as an explanatory case in which the indoor heat exchanger 5*a* is used in heating operation and the indoor heat exchanger 5*b* is used in cooling operation and in which the heating load is larger than the cooling load.

When a heating only operation or a heating main operation is set to the indoor units 200A, first, the four-way valve 3 of the outdoor unit 100A is switched to the heating side (S61) and the flow-dividing-controller expansion valve LEV1 of the flow dividing controller 400A is closed (S62). Further, the solenoid valves SV11 to SV14 and the check valves CV11 to CV14 are controlled such that the refrigerant flows in the order of the gas-liquid separator 62, the solenoid valve SV13, the indoor heat exchanger 5*a*, the indoor expansion valve 7*a*, the check valve CV13, the check valve CV12, the indoor expansion valve 7*b*, the indoor heat exchanger 5*b*, the solenoid valve SV12, and the return piping 65.

Next, an outdoor air temperature AT is read from the temperature sensor TH7 and a compressor suction side evaporating temperature Te, which has been converted from a detection value of the low-pressure sensor Ps, is read, as well as an operating frequency fz of the compressor 1 (S63).

The read outdoor air temperature AT is compared with a preset temperature ATmin (S64). ATmin is a preset temperature that is equal to or above an outdoor air temperature that hinders normal operation control of the air-conditioning apparatus due to the increase of the discharge temperature of the compressor caused by drop of low pressure. If AT is lower than ATmin, the opening degrees of the expansion valve LEV1*a* of the additional unit 300A and the return bypass expansion valve LEV3 of the return bypass 66 are controlled such that the compressor suction side evaporating temperature Te is within a fixed range (from 2 to 11 degrees C., for example) (S65). Note that since the refrigerant is made to flow to the indoor heat exchanger carrying out heating operation utilizing the passage resistance, the return bypass expansion valve LEV3 is controlled such that the pressure before and after the flow-dividing-controller expansion valve LEV1 (PS1-PS3) is within a fixed range AP.

Next, whether to use the outdoor heat exchanger 12 will be determined. The outdoor air temperature AT and the compressor suction side evaporating temperature Te are compared (S66), and if AT is higher than Te, the solenoid valve SV2 is opened and the solenoid valve SV3 is closed so that the refrigerant that has returned to the outdoor unit 100A passes through the outdoor heat exchanger 12 (S67). In other words, the refrigerant is also made to flow into the outdoor heat exchanger 12 so that the outdoor heat exchanger 12 is used as an evaporator, and the outdoor fan 14 is operated (S68). Accordingly, the refrigerant that has entered the outdoor unit 100A returns to the compressor 1 through the check valve CV3*a*, the solenoid valve SV2, the outdoor heat exchanger 12, the check valve CV8*a*, the check valve CV4*a*, and the four-way valve 3.

On the other hand, if AT is equal to or lower than Te in step S66, the solenoid valve SV2 is closed and the solenoid valve SV3 is opened so as to forbid the refrigerant that has returned to the outdoor unit 100A to flow into the outdoor heat exchanger 12 (S69). Additionally, the outdoor fan 14 is also stopped (S70). That is, if the outdoor air temperature AT is equal to or lower than the compressor suction side evaporating temperature Te, the outdoor heat exchanger 12 is not used and only the auxiliary heat exchanger 24 is used as the evaporator, and a heating operation in which a heat source of the boiler 51 is used is carried out. In this case, the refrigerant that has entered the outdoor unit 100A returns to the compressor 1 through the check valve CV3*a*, the solenoid valve SV3, the check valve CV4*a*, and the four-way valve 3. At this time, the solenoid valve SV2 acts to prevent the refrigerant from stagnating in the outdoor heat exchanger 12.

Furthermore, in step S64, if AT is equal to or higher than ATmin, the degree of margin of the operating capacity is determined from the operating frequency of the compressor 1 (S71). That is, the operating frequency fz of the compressor 1 is compared with the value obtained by multiplying a threshold value FR, which is set as a ratio of usage of the external heat source, to the maximum operating frequency fzMax of the compressor 1, and if fz>fxMax×FR, then it is determined that there is no margin in the driving capacity of the compressor 1, and the control proceeds to step S65 in which the auxiliary heat exchanger 24 is used. On the other hand, if fz is equal to or less than fzMax×FR, as it is determined that there is some margin in the driving capacity of the compressor 1, a heating operation without using the auxiliary heat exchanger 24 is carried out. That is, the heating main operation is carried out by totally closing the expansion valve LEV1*a* of the additional unit 300A (S72), the solenoid valve SV2 is opened, and the solenoid valve SV3 is closed (S73). At this time, the outdoor fan 14 is operated (S74).

In the air-conditioning apparatus of Embodiment 4, by providing the additional unit 300A to the air-conditioning apparatus that can carry out cooling operation and heating operation at the same time, the same advantageous effects described in Embodiments 1 to 3 can be obtained. That is, since an auxiliary heat exchanger of a different heat source from the refrigerant heat source of the refrigeration cycle is provided, continuous heating operation can be carried out even under a low outdoor air temperature environment where the air-conditioning apparatus is not operable. Furthermore, since the evaporating temperature in the refrigeration cycle increases, the amount of refrigerant circulation increases and the heating capacity increases. Additionally, since the outdoor air temperature AT and the compressor suction side evaporating temperature Te are compared, the outdoor heat exchanger 12 can be effectively utilized during a heating operation under a low outdoor temperature environment.

Note that although in the description of Embodiment 4, an example of a heating main operation has been given, the same can be applied during a heating only operation. That is, during the heating only operation, the flow-dividing-controller expansion valve LEV1 of the flow dividing controller 400A is also totally closed. Further, the refrigerant from the gas piping 63 of the flow dividing controller 400A flows into all of the operating indoor heat exchangers 5*a* and 5*b*, and the refrigerant that has flowed out of the indoor heat exchangers 5*a* and 5*b* flows to the liquid piping 64 through the indoor expansion valves 7*a* and 7*b*. The refrigerant that has entered the liquid piping 64, is separated into a refrigerant passing the additional unit 300A and a refrigerant passing the return bypass 66 in accordance to the opening degrees of the expansion valve LEV1*a* and the expansion valve LEV3, and, subsequently, merges in the return piping 65. Accordingly, in the heating only operation, by controlling the expansion valve LEV1*a* of the additional unit 300A and the expansion valve LEV3 of the return bypass 66 in the same manner as that of the heating main operation, same advantageous effects as that of the heating main operation can be obtained.

On the other hand, when the cooling only operation or the cooling main operation is carried out in the air-conditioning apparatus of FIG. 4, the four-way valve 3 is switched to the cooling side and the refrigerant discharged from the compressor 1 is made to flow out from the outdoor unit through the outdoor heat exchanger 12. During the cooling only operation, the flow-dividing-controller expansion valve LEV1 is fully opened and the other expansion valves LEV3 and LEV1*a* are totally closed, so as to distribute the refrigerant for cooling to the indoor heat exchangers. Further, during the cooling main operation, the flow-dividing-controller expansion valve LEV1 is controlled such that the pressure (PS1-PS3) becomes a constant pressure AP and the other expansion valves LEV3 and LEV1*a* are totally closed so as to distribute the refrigerant for cooling to the indoor heat exchanger for cooling and the refrigerant for heating to the indoor heat exchanger for heating.

Next, a defrosting operation of the air-conditioning apparatuses of Embodiments 1 to 4 will be described. In any of the air-conditioning apparatuses of Embodiments 1 to 4, when the outdoor heat exchanger 12 is not used and the auxiliary heat exchanger 24 alone is used as an evaporator, no defrosting operation is required and a non-stop heating operation can be carried out.

On the other hand, when in Embodiments 1 and 4, the outdoor heat exchanger 12 is used as an evaporator, frost attached to the outdoor heat exchanger 12 is removed by hot gas defrosting of the normal reverse defrosting operation.

Figure 10:
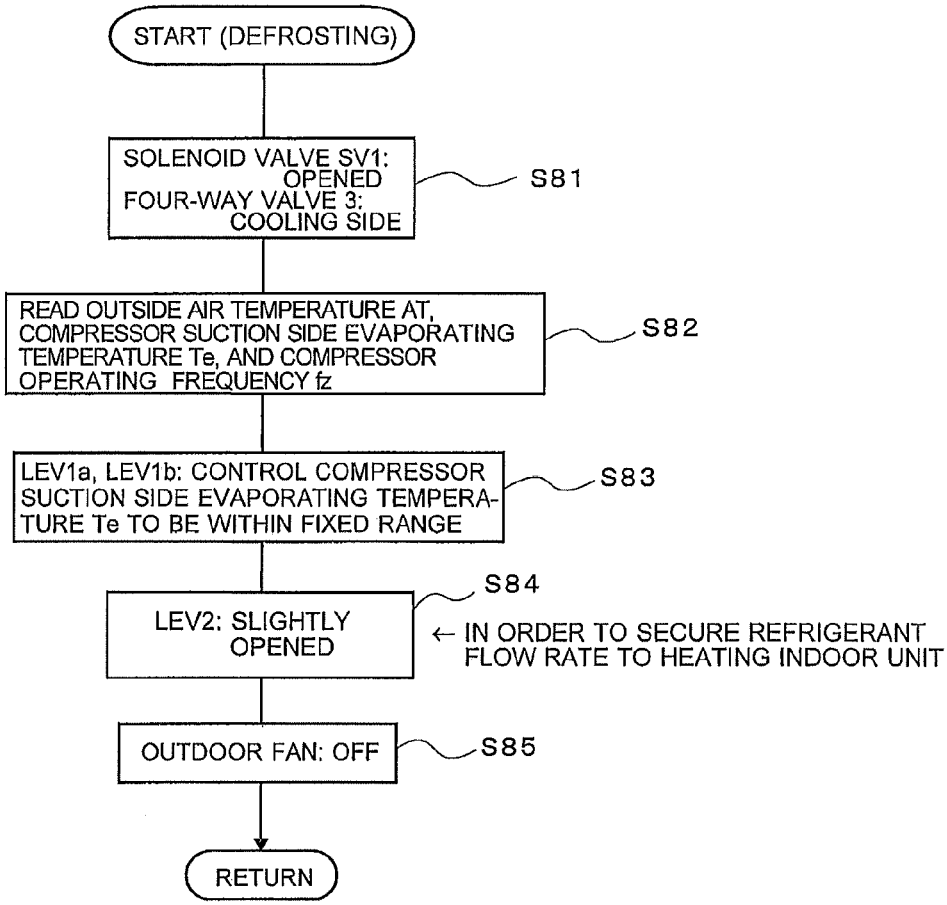
FIG. 10 is a flowchart illustrating control of a defrosting operation of the air-conditioning apparatus of FIG. 2.

Further, when in Embodiments 2 and 3, the outdoor heat exchanger 12 is used as an evaporator, along with the heating operation, a defrosting operation described in the flowchart of FIG. 10 is carried out. That is, when it is determined that frost has been formed on the outdoor heat exchanger 12, the solenoid valve SV1 is opened and the four-way valve 3 is switched to the cooling side (S81). As such, a portion of the refrigerant (hot gas) discharged from the compressor 1 is distributed to the outdoor heat exchanger 12 through the solenoid valve SV1 and the four-way valve 3, and is used to defrost the outdoor heat exchanger 12.

The refrigerant that has left the outdoor heat exchanger 12 merges in the additional unit 300 with the refrigerant that has been used for heating in the indoor units 200, and returns to the outdoor unit 100 through the first bypass 22*a* and the second bypass 22*b*. At this state, the outdoor air temperature AT, the suction side evaporating temperature Te of the compressor 1, and the operating frequency of the compressor 1 is read (S82). Note that in the control of the defrosting operation, only the suction side evaporating temperature Te of the compressor 1 is used. In this case, each of the expansion valves LEV1*a* and LEV1*b* is controlled such that the compressor suction side evaporating temperature Te is within a fixed range (S83) and the liquid piping expansion valve LEV2 (the outdoor expansion valve LEV2' in case of FIG. 3) is controlled so as to be slightly opened (S84). The reason for controlling the liquid piping expansion valve LEV2 so as to be slightly opened is so secure the flow rate of the refrigerant flowing into the indoor heat exchanger that is carrying out the heating operation. Note that during the defrosting operation, the outdoor fan 14 is stopped (S85).

As such, a non-stop heating operation and a non-stop defrosting operation can be carried out and the comfortability in the indoor space being air conditioned by the indoor heat exchangers is increased.

Embodiment 5

Figure 11:
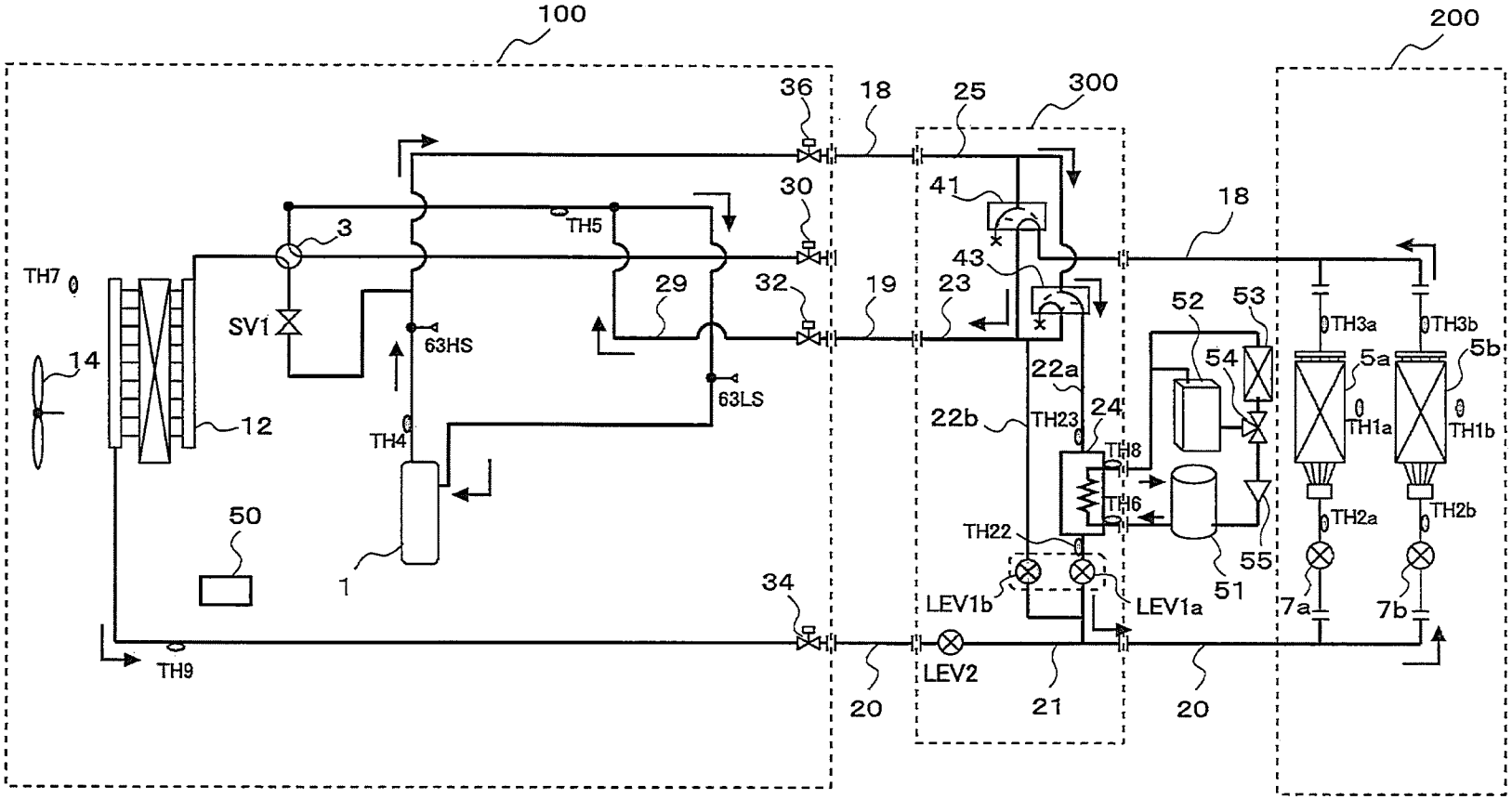
FIG. 11 is a block diagram of an air-conditioning apparatus illustrating Embodiment 5 of the invention.

Next, a hot water operation (or a heating operation) using the cooling operation of the air-conditioning apparatus of Embodiment 2 will be described. FIG. 11 is a block diagram of an air-conditioning apparatus illustrating Embodiment 5 of the invention. First, the different points of the air-conditioning apparatus of Embodiment 5 and the air-conditioning apparatus of Embodiment 2 will be described.

Here, a four-way valve 43 (for switching the auxiliary heat exchanger 24 to cooling/heating) is provided to the additional unit gas piping 25 of the additional unit 300 in parallel with the four-way valve 41 (for switching the indoor heat exchangers 5*a* and 5*b* to cooling/heating). The four-way valve 43 performs switching such that the refrigerant that has been discharged from the compressor 1 flows to the auxiliary heat exchanger 24 during cooling operation or the refrigerant that has left the auxiliary heat exchanger 24 flows to the merging bypass 23 during heating operation.

Further, in the water circuit of the auxiliary heat exchanger 24 performing heat exchange between the refrigerant and water, a water circulating circuit is formed, which is provided with a tank 52 capable of receiving and discharging water and capable of storing hot water, a pump 55, and the boiler 51. Furthermore, in this example, a radiator 53 for heating is provided in parallel with the tank 52. The switching of the passage between the tank 52 and the radiator 53 is carried out by using a three-way valve 54.

During the cooling operation, the refrigerant that has left the compressor 1 enters the outdoor heat exchanger 12 through the solenoid valve SV1 and the four-way valve 3. The refrigerant that has left the outdoor heat exchanger 12 enters the indoor units 200 through the liquid piping expansion valve LEV2. The refrigerant that has entered the indoor units 200 enters the indoor heat exchangers 5*a* and 5*b* through the indoor expansion valves 7*a* and 7*b*, and is used for cooling the indoor space. The refrigerant that has left the indoor heat exchangers 5*a* and 5*b* enters the merging bypass 23 through the four-way valve 41, and, subsequently, enters the outdoor unit 100 through the bypass extension piping 19, and then returns to the compressor 1 through the inlet bypass 29.

Meanwhile, a portion of the refrigerant that has been discharged from the compressor 1 enters the additional unit gas piping 25 of the additional unit 300 through the gas extension piping 18. Subsequently, the refrigerant enters the auxiliary heat exchanger 24 through the four-way valve 43 and the first bypass 22*a* and transfers heat to the water in the water circuit. The refrigerant that has left the auxiliary heat exchanger 24 merges with the refrigerant that has passed through the outdoor heat exchanger 12, and enters the indoor units 200. Note that in this operation, the first bypass expansion valve LEV1*a* controls the subcooling (SC control) of the outlet refrigerant of the auxiliary heat exchanger 24 by using the temperature sensor TH22, and the second bypass expansion valve LEV1*b* is closed.

With the above combination of the cooling operation and the water heating operation, heating of water with the boiler 51 is assisted by the high-temperature refrigerant from the compressor 1, and, thus, improvement of energy saving is achieved. Further, there is superiority in that this can be built in existing air-conditioning apparatuses or in existing hot water circuits.

Embodiment 6

Figure 12:
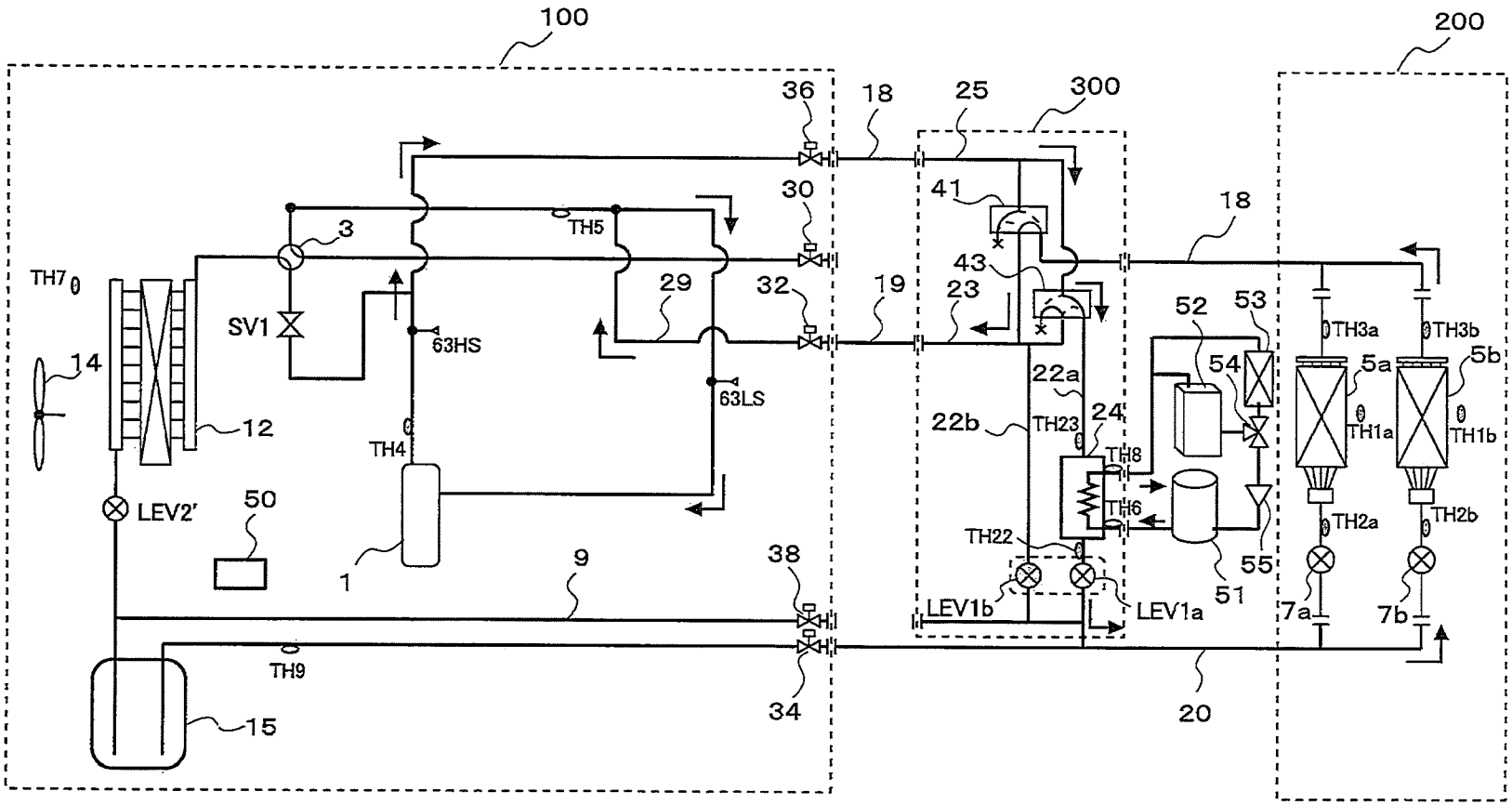
FIG. 12 is a block diagram of an air-conditioning apparatus illustrating Embodiment 6 of the invention.

Next, a hot water operation (or a heating operation) using the cooling operation of the air-conditioning apparatus of Embodiment 3 will be described. FIG. 12 is a block diagram of an air-conditioning apparatus illustrating Embodiment 6 of the invention. First, the different points of the air-conditioning apparatus of Embodiment 6 and the air-conditioning apparatus of Embodiment 3 will be described.

Here, a four-way valve 43 (for switching the auxiliary heat exchanger 24 to cooling/heating) is provided to the unit gas piping 25 of the additional unit 300 in parallel with the four-way valve 41 (for switching the indoor heat exchangers 5*a* and 5*b* to cooling/heating). The four-way valve 43 performs switching such that the refrigerant that has been discharged from the compressor 1 flows to the auxiliary heat exchanger 24 during cooling operation or the refrigerant that has left the auxiliary heat exchanger 24 flows to the merging bypass 23 during heating operation.

Further, in the water circuit of the auxiliary heat exchanger 24 performing heat exchange between the refrigerant and water, a water circulating circuit is formed, which is provided with a tank 52 capable of receiving and discharging water and capable of storing hot water, a pump 55, and the boiler 51. Furthermore, in this example, a radiator 53 for heating is provided in parallel with the tank 52. Note that the switching of the passage between the tank 52 and the radiator 53 is carried out by using a three-way valve 54.

During the cooling operation, the refrigerant that has left the compressor 1 enters the outdoor heat exchanger 12 through the solenoid valve SV1 and the four-way valve 3. The refrigerant that has left the outdoor heat exchanger 12 enters the indoor units 200 through the outdoor expansion valve LEV2', the receiver 15, and the liquid extension piping 20. The refrigerant that has entered the indoor units 200 enters the indoor heat exchangers 5*a* and 5*b* through the indoor expansion valves 7*a* and 7*b*, and is used for cooling the indoor space. The refrigerant that has left the indoor heat exchangers 5*a* and 5*b* enters the merging bypass 23 through the four-way valve 41, and, subsequently, enters the outdoor unit 100 through the bypass extension piping 19 and the inlet bypass 29, and then returns to the compressor 1.

Meanwhile, a portion of the refrigerant that has been discharged from the compressor 1 enters the unit gas piping 25 of the additional unit 300 through the gas extension piping 18. Subsequently, the refrigerant enters the auxiliary heat exchanger 24 through the four-way valve 43 and the first bypass 22*a* and transfers heat to the water in the water circuit. The refrigerant that has left the auxiliary heat exchanger 24 merges with the refrigerant that has passed through the outdoor heat exchanger 12 and the receiver 15, and enters the indoor units 200. Note that in this operation, the first bypass expansion valve LEV1*a* controls the subcooling (SC control) of the outlet refrigerant of the auxiliary heat exchanger 24 by using the temperature sensor TH22, and the second bypass expansion valve LEV1*b* is closed.

With the above combination of the cooling operation and the water heating operation, heating of water in the boiler 51 is assisted by the high-temperature refrigerant from the compressor 1, and, thus, improvement of energy saving is achieved. Further, there is superiority in that this advantage can be built in existing air-conditioning apparatuses or in existing hot water circuits.

Note that the four-way valves 41 and 43 used in Embodiments 2, 3, 5 and 6 can be replaced with three-way valves.

Further, although in each Embodiment, a boiler has been described as the heat source of the auxiliary heat exchanger, not limited to the boiler, other heat sources such as an electric heater or geothermal energy may be used.

Furthermore, the refrigerant used in each Embodiment is not limited to a specific one, and known refrigerants for air conditioners may be used. Note that an R32 refrigerant increases the low temperature of the heating operation by about 30K to that of an R410A refrigerant. However, when R32 refrigerant is used in the air-conditioning apparatuses of the above Embodiments, since the evaporating temperature rises and the discharge temperature drops, the operable range of the heating operation of R32 is broadened.

What is claimed is:

1. An air-conditioning apparatus, comprising:

an outdoor unit including a compressor that compresses and discharges a refrigerant, a discharge port that discharges the refrigerant that has been discharged from the compressor to an outer portion, a first flow switching device that is connected to a passage branching off from a passage between the compressor and the discharge port and that switches a passage of the refrigerant discharged from the compressor, an outdoor heat exchanger that is connected by piping to the first flow switching device and is used to evaporate or condense the refrigerant, and an on-off device that opens and closes the branched off passage between the compressor and the first flow switching device;

an indoor unit including an indoor heat exchanger that functions as a condenser condensing the refrigerant discharged from the compressor during a heating operation and an indoor expansion valve that controls a flow rate of the refrigerant leaving the indoor heat exchanger during the heating operation;

a gas extension piping constituting a passage communicating the discharge port of the outdoor unit to the indoor heat exchanger of the indoor unit;

a liquid extension piping constituting a passage communicating the indoor expansion valve of the indoor unit to the outdoor heat exchanger of the outdoor unit;

a refrigerant circuit of a refrigeration cycle being formed by the outdoor unit and the indoor unit connected through the gas extension piping and the liquid extension piping;

a second flow switching device provided in the gas extension piping between the discharge port of the outdoor unit and the indoor heat exchanger of the indoor unit, the second flow switching device communicating the indoor heat exchanger to a discharge side of the compressor during the heating operation and communicating the indoor heat exchanger to a suction side of the compressor during a cooling operation;

a liquid piping expansion valve provided in the liquid extension piping between the indoor expansion valve of the indoor unit and the outdoor heat exchanger of the outdoor unit, the liquid piping expansion valve being capable of controlling a throughput of the refrigerant;

an additional unit having a first bypass and a second bypass that branch off from a passage between the indoor unit and the liquid piping expansion valve, the first bypass and the second bypass communicating to a passage between the first flow switching device and the suction side of the compressor;

the first bypass having a first bypass expansion valve that is capable of controlling a throughput of the refrigerant and an auxiliary heat exchanger with a heat source different from the outdoor heat exchanger, the auxiliary heat exchanger functioning as an evaporator that heats the refrigerant flowing in the first bypass during the heating operation; and the second bypass having a second bypass expansion valve that is capable of controlling a throughput of the refrigerant.

2. The air-conditioning apparatus of claim 1, wherein during the heating operation, (i) when an outdoor air temperature is lower than a preset lower limit temperature or an operating frequency of the compressor is higher than a predetermined value, and (ii) when the outdoor air temperature is equal to or lower than a refrigerant evaporating temperature on a suction side of the compressor, the liquid piping expansion valve is closed and the refrigerant from the indoor unit is distributed to the first bypass and the second bypass.

3. The air-conditioning apparatus of claim 1, wherein during the heating operation, (i) when an outdoor air temperature is lower than a preset lower limit temperature or an operating frequency of the compressor is higher than a predetermined value, and (ii) when the outdoor air temperature is higher than a refrigerant evaporating temperature on a suction side of the compressor, an opening degree of the liquid piping expansion valve is controlled on the basis of a degree of superheat of the refrigerant that has left the outdoor heat exchanger and the refrigerant from the indoor unit is distributed to the outdoor heat exchanger, the first bypass, and the second bypass.

4. The air-conditioning apparatus of claim 2, wherein the first bypass expansion valve and the second bypass expansion valve are controlled such that the refrigerant evaporating temperature on the suction side of the compressor is within a fixed range.

5. The air-conditioning apparatus of claim 1, wherein the auxiliary heat exchanger exchanges heat between the refrigerant and water, and the air-conditioning apparatus further comprises a third flow switching device that is provided in the gas extension piping, the third flow switching device communicating the first bypass to a discharge side of the compressor during the cooling operation and communicating the first bypass to the suction side of the compressor during a heating operation, and a water side circulating passage of the auxiliary heat exchanger that includes the different heat source, a hot water tank or a radiator for heating, and a pump.

6. The air-conditioning apparatus of claim 1, wherein the refrigerant is an R32 refrigerant.

7. The air-conditioning apparatus of claim 1, wherein when it is determined that frost is formed on the outdoor heat exchanger during the heating operation using the outdoor heat exchanger, the first flow switching device is switched to the cooling operation side and the on-off valve is opened to carry out hot gas defrosting.

8. An air-conditioning apparatus, comprising:

an outdoor unit including a compressor that compresses and discharges a refrigerant, a discharge port that discharges the refrigerant that has been discharged from the compressor to an outer portion, a first flow switching device that is connected to a passage branching off from a passage between the compressor and the discharge port and that switches a passage of the refrigerant discharged from the compressor, an outdoor heat exchanger that is connected by piping to the first flow switching device and is used to evaporate or condense the refrigerant, an on-off device that opens and closes the branched off passage between the compressor and the first flow switching device, an outdoor expansion valve that is provided on an upstream side of the outdoor heat exchanger during heating operation, a receiver that retains the refrigerant, and an intermediate-pressure port provided in a passage branching off from the passage between the outdoor heat exchanger and the receiver;

an indoor unit including an indoor heat exchanger that functions as a condenser condensing the refrigerant discharged from the compressor during a heating operation and an indoor expansion valve that controls a flow rate of the refrigerant leaving the indoor heat exchanger during the heating operation;

a gas extension piping constituting a passage communicating the discharge port of the outdoor unit to the indoor heat exchanger of the indoor unit;

a liquid extension piping constituting a passage communicating the indoor expansion valve of the indoor unit to the receiver of the outdoor unit;

a refrigerant circuit of a refrigeration cycle being formed by the outdoor unit and the indoor unit connected through the gas extension piping and the liquid extension piping;

a second flow switching device provided in the gas extension piping between the discharge port of the outdoor unit and the indoor heat exchanger of the indoor unit, the second flow switching device communicating the indoor heat exchanger to a discharge side of the compressor during the heating operation and communicating the indoor heat exchanger to a suction side of the compressor during a cooling operation;

an additional unit having a first bypass and a second bypass, the first bypass and the second bypass each having one end in communication with the intermediate-pressure port of the outdoor unit and the other end in communication with a passage between the first flow switching device and the suction side of the compressor;

the first bypass having a first bypass expansion valve that is capable of controlling a throughput of the refrigerant and an auxiliary heat exchanger with a heat source different from the outdoor heat exchanger, the auxiliary heat exchanger functioning as an evaporator that heats the refrigerant flowing in the first bypass during the heating operation; and the second bypass having a second bypass expansion valve that is capable of controlling a throughput of the refrigerant.

9. The air-conditioning apparatus of claim 8, wherein during the heating operation, (i) when an outdoor air temperature is lower than a preset lower limit temperature or an operating frequency of the compressor is higher than a predetermined value, and (ii) when the outdoor air temperature is equal to or lower than a refrigerant evaporating temperature on a suction side of the compressor, the outdoor expansion valve is closed and the refrigerant from the indoor unit is distributed to the first bypass and the second bypass.

10. The air-conditioning apparatus of claim 8, wherein during the heating operation, (i) when an outdoor air temperature is lower than a preset lower limit temperature or an operating frequency of the compressor is higher than a predetermined value, and (ii) when the outdoor air temperature is higher than a refrigerant evaporating temperature on a suction side of the compressor, an opening degree of the outdoor expansion valve is controlled on the basis of a degree of superheat of the refrigerant that has left the outdoor heat exchanger and the refrigerant from the indoor unit is distributed to the outdoor heat exchanger, the first bypass, and the second bypass.

11. The air-conditioning apparatus of claim 9, wherein the first bypass expansion valve and the second bypass expansion valve are controlled such that the refrigerant evaporating temperature on the suction side of the compressor is within a fixed range.

12. The air-conditioning apparatus of claim 8, wherein the auxiliary heat exchanger exchanges heat between the refrigerant and water, and the air-conditioning apparatus further comprises a third flow switching device that is provided in the gas extension piping, the third flow switching device communicating the first bypass to a discharge side of the compressor during the cooling operation and communicating the first bypass to the suction side of the compressor during a heating operation, and a water side circulating passage of the auxiliary heat exchanger that includes the different heat source, a hot water tank or a radiator for heating, and a pump.

13. The air-conditioning apparatus of claim 8, wherein the refrigerant is an R32 refrigerant.

14. The air-conditioning apparatus of claim 8, wherein when it is determined that frost is formed on the outdoor heat exchanger during the heating operation using the outdoor heat exchanger, the first flow switching device is switched to the cooling operation side and the on-off valve is released to carry out hot gas defrosting.

* * * * *